US010669686B2

(12) United States Patent
Stroyer

(10) Patent No.: US 10,669,686 B2
(45) Date of Patent: Jun. 2, 2020

(54) PILE COUPLING FOR HELICAL PILE/TORQUED IN PILE

(71) Applicant: Benjamin G. Stroyer, East Rochester, NY (US)

(72) Inventor: Benjamin G. Stroyer, East Rochester, NY (US)

( * ) Notice: Subject to any disclaimer, the term of this patent is extended or adjusted under 35 U.S.C. 154(b) by 0 days.

(21) Appl. No.: 16/379,826

(22) Filed: Apr. 10, 2019

(65) Prior Publication Data

US 2019/0368149 A1 Dec. 5, 2019

Related U.S. Application Data

(60) Division of application No. 15/678,599, filed on Aug. 16, 2017, now abandoned, which is a (Continued)

(51) Int. Cl.

| | |
|---|---|
| ***E02D 5/56*** | (2006.01) |
| ***E02D 5/34*** | (2006.01) |
| ***E02D 27/12*** | (2006.01) |
| ***E02D 11/00*** | (2006.01) |
| ***E02D 5/52*** | (2006.01) |
| ***E02D 5/36*** | (2006.01) |
| ***E02D 5/28*** | (2006.01) |
| ***E02D 5/46*** | (2006.01) |

(Continued)

(52) U.S. Cl.

CPC ..... *E02D 5/34* (2013.01); *E02D 5/24* (2013.01); *E02D 5/28* (2013.01); *E02D 5/285* (2013.01); *E02D 5/36* (2013.01); *E02D 5/46* (2013.01); *E02D 5/52* (2013.01); *E02D 5/523* (2013.01); *E02D 5/526* (2013.01); *E02D 5/56* (2013.01); *E02D 5/801* (2013.01); *E02D 5/808* (2013.01); *E02D 11/00* (2013.01); *E02D 27/12* (2013.01)

(58) Field of Classification Search

CPC ..... E02D 5/523; E02D 5/526; E02D 5/56
USPC ..... 405/241, 244, 251, 252.1; 248/530; 52/157, 165

See application file for complete search history.

(56) References Cited

U.S. PATENT DOCUMENTS 1,781,091 A * 11/1930 Wilson ..... E21B 17/046 285/148.19

4,702,639 A 10/1987 Hinterholzer (Continued)

OTHER PUBLICATIONS

International Search Report for PCT/US2016/016987 dated Aug. 8, 2017.

*Primary Examiner* — Sunil Singh

(57) ABSTRACT

A pile includes a first pile section having a first end that engages a supporting medium and an opposing second end. A first end of a second pile section is engageable with the second end of the first pile section, each of the first and second pile sections having mating end fittings that create an interlocking fit. A sleeve overlays the first and second engaged ends of the first and second pile sections. At least one through hole aligned with at least one corresponding through hole of the first pile section is sized for receiving a fastener for securing the sleeve to the first pile section. In another version, the ends of the pile section are engaged in contact while the overlaying sleeve has a pair of interlocking sleeve or coupler portions that are configured to provide torsional resistance. Additional pile sections can be sequentially attached to the second pile section.

17 Claims, 24 Drawing Sheets

Related U.S. Application Data continuation-in-part of application No. 14/577,363, filed on Dec. 19, 2014, now Pat. No. 10,480,144, which is a continuation of application No. 13/269,595, filed on Oct. 9, 2011, now Pat. No. 8,926,228, which is a continuation-in-part of application No. 12/580,004, filed on Oct. 15, 2009, now Pat. No. 8,033,757, which is a continuation-in-part of application No. 11/852,858, filed on Sep. 10, 2007, now abandoned, said application No. 15/678,599 is a continuation-in-part of application No. 15/018,360, filed on Feb. 8, 2016, now abandoned.

(60) Provisional application No. 60/843,015, filed on Sep. 8, 2006, provisional application No. 62/112,952, filed on Feb. 6, 2015.

(51) Int. Cl.
*E02D 5/24* (2006.01)
*E02D 5/80* (2006.01)

(56) References Cited

U.S. PATENT DOCUMENTS

| | | | | |
|---|---|---|---|---|
| 4,821,818 | A | 4/1989 | Mefferd | |
| 7,220,081 | B1 * | 5/2007 | Gantt, Jr. | E02D 27/12 405/230 |
| 2003/0041535 | A1 | 3/2003 | Rupiper | |
| 2005/0074298 | A1 * | 4/2005 | Jones | E02D 5/523 405/252.1 |
| 2007/0286685 | A1 | 12/2007 | Lindsey | |
| 2016/0215470 | A1 * | 7/2016 | Reusing | E02D 5/56 |

* cited by examiner

PILE COUPLING FOR HELICAL PILE/TORQUED IN PILE

CROSS-REFERENCE TO RELATED APPLICATIONS

This application is a divisional application of U.S. patent application Ser. No. 15/678,599, filed on Aug. 16, 2017, and claims priority, under 35 U.S.C. § 120, from U.S. patent application Ser. No. 15/678,599; said U.S. patent application Ser. No. 15/678,599 is a continuation-in-part application of U.S. patent application Ser. No. 14/577,363, filed on Dec. 19, 2014, and claims priority, under 35 U.S.C. § 120, from U.S. patent application Ser. No. 14/577,363; said U.S. patent application Ser. No. 14/577,363, filed on Dec. 19, 2014, is a continuation of U.S. patent application Ser. No. 13/269,595, filed on Oct. 9, 2011, and claims priority, under 35 U.S.C. § 120, from U.S. patent application Ser. No. 13/269,595; said U.S. patent application Ser. No. 13/269,595, filed on Oct. 9, 2011, is a continuation-in-part of U.S. patent application Ser. No. 12/580,004, filed on Oct. 15, 2009, and claims priority, under 35 U.S.C. § 120, from U.S. patent application Ser. No. 12/580,004; said U.S. patent application Ser. No. 12/580,004, filed on Oct. 15, 2009, is a continuation-in-part of U.S. patent application Ser. No. 11/852,858, filed on Sep. 10, 2007, and claims priority, under 35 U.S.C. § 120, from U.S. patent application Ser. No. 11/852,858; said U.S. patent application Ser. No. 11/852,858, filed on Sep. 10, 2007, claiming priority 35 USC § 119(e) from U.S. Provisional Patent Application, Ser. No. 60/843,015, filed on Sep. 8, 2006. Said US Patent Application U.S. patent application Ser. No. 15/678,599 is a continuation-in-part application of U.S. patent application Ser. No. 15/018,360, filed on Feb. 8, 2016, and claims priority, under 35 U.S.C. § 120, from U.S. patent application Ser. No. 15/018,360; said U.S. patent application Ser. No. 15/018,360, filed on Feb. 8, 2016, claiming priority 35 USC § 119(e) from U.S. Provisional Patent Application, Ser. No. 62/112,952, filed on Feb. 6, 2015. Each of the above-listed patents and applications are incorporated herein by reference in their entirety.

TECHNICAL FIELD

This disclosure generally pertains to pile couplings for helical piles or torqued in piles and more specifically to a pile coupling that is configured to better distribute applied torsional loads in use.

BACKGROUND

Conventional piles are metal tubes having either a circular or a rectangular cross-section. Such piles are mounted in the ground to provide a support structure for the construction of superstructures. The piles are provided in sections, such as seven-foot sections, that are driven into the ground.

Some piles have a cutting tip that permits them to be rapidly deployed. By rotating the pile, the blade pulls the pile into the ground, thus greatly reducing the amount of downward force necessary to bury the pile. For example, a pile may include a tip that is configured to move downward into the soil at a rate of three inches for every full revolution of the pile (three inch pitch). Since pre-drilling operations are unnecessary, the entire pile may be installed in under ten minutes. Unfortunately, the rotary action of the pile also loosens the soil which holds the pile in place. This reduces the amount of vertical support the pile provides. Traditionally, grout is injected around the pile in an attempt to solidify the volume around the pile and thus compensate for the loose soil. The current method of grout deployment is less than ideal. The addition of grout to the area around the pile typically is uncontrolled and attempts to deploy grout uniformly about the pile have been unsuccessful. Often the introduction of the grout itself can cause other soil packing problems, as the soil must necessarily be compressed by the introduction of the grout. A new method for introducing grout around a pile would be advantageous.

Helical or torqued in piles are used in various aspects of construction in order to establish compression or tension resistance in a supporting medium (e.g. soil, rock, etc.). Helical piles, for example, have a helical flighting on a first pile section defined by a pile shaft that is contacted to a surface of the supporting medium. Upon rotation, the helical flighting pulls the first pile section into the supporting medium. After the first pile section has reached a certain depth, a second pile section having a welded or forged coupling, is attached to the first pile section using at least one bolt through formed holes. Rotation of the second pile section applies a torque to the first pile section to continue the rotation and drive the helical pile to a greater depth in the supporting medium. Subsequent pile sections may be sequentially attached to enable the pile to reach a predetermined depth.

Conventional pile couplings are forged or welded to one end of the pile shaft and often are inserted into the second pile section within or around the first pile section and then fastened to the previous pile section together by inserting one or more pins through side holes formed in the pile coupling and the first pile section. Unfortunately, the applied torque that is produced during helical pile installation is significant and will cause elongation in the side holes. Further, the torque transfer depends on the weld at the coupling and weld failure is a recurrent problem. Some known pile couplings incorporate an additional forged end which is provided in order to help transfer the torsion load, but this latter feature is expensive to incorporate and involves additional welding. As a result, an improved pile coupling is therefore desired.

A pile coupling that would transfer a large portion of the torsional load directly down the pile shaft would advantageous, thereby resisting the torque that is to be resisted by the pins alone.

BRIEF DESCRIPTION

Therefore and according to a first aspect, there is provided a pile assembly comprising a first pile section defined by a first end that is configured for engaging a supporting medium and an opposing second end. A second pile section has a first end engageable with the second end of the first pile section, each of the first and second pile sections having mating end fittings that create an interlocking fit. The pile assembly further includes a sleeve sized to overlay the first and second engaged ends of the first and second pile sections, the sleeve having at least one through hole aligned with at least one corresponding through hole of the first pile section, the at least one through hole being sized for receiving a fastener for securing the sleeve to the first pile section.

According to another aspect, there is provided a pile comprising a first pile section defined by a first end that is configured for engaging a supporting medium and an opposing second end and a second pile section having a first end engageable with the second end of the first pile section. A sleeve is sized to overlay the first and second engaged ends of the first and second pile sections, the sleeve having at least one through hole aligned with at least one corresponding through hole of the first pile section, the at least one through hole being sized for receiving fastener for securing the sleeve to the first pile section and in which the sleeve is defined by a pair of sleeve sections, each sleeve section having a mated fitting at one end that creates an interlocking fit when the sleeve sections are engaged with one another.

In each of the above, the mated fittings are defined so as to create an interlocking fit between the pile sections or between the sleeve portions, thereby more effectively distributing an applied torsional load.

An advantage realized is that the herein described pile enables greater distribution of an applied torsional load between engaged pile sections, particularly on the fasteners of the pile coupling, thereby ensuring greater reliability and fewer failures or delays.

These and other embodiments, features and advantages will become apparent to those skilled in the art when taken in reference to the following more detailed description of various embodiments of the invention in conjunction with the accompanying drawings that are first briefly described.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
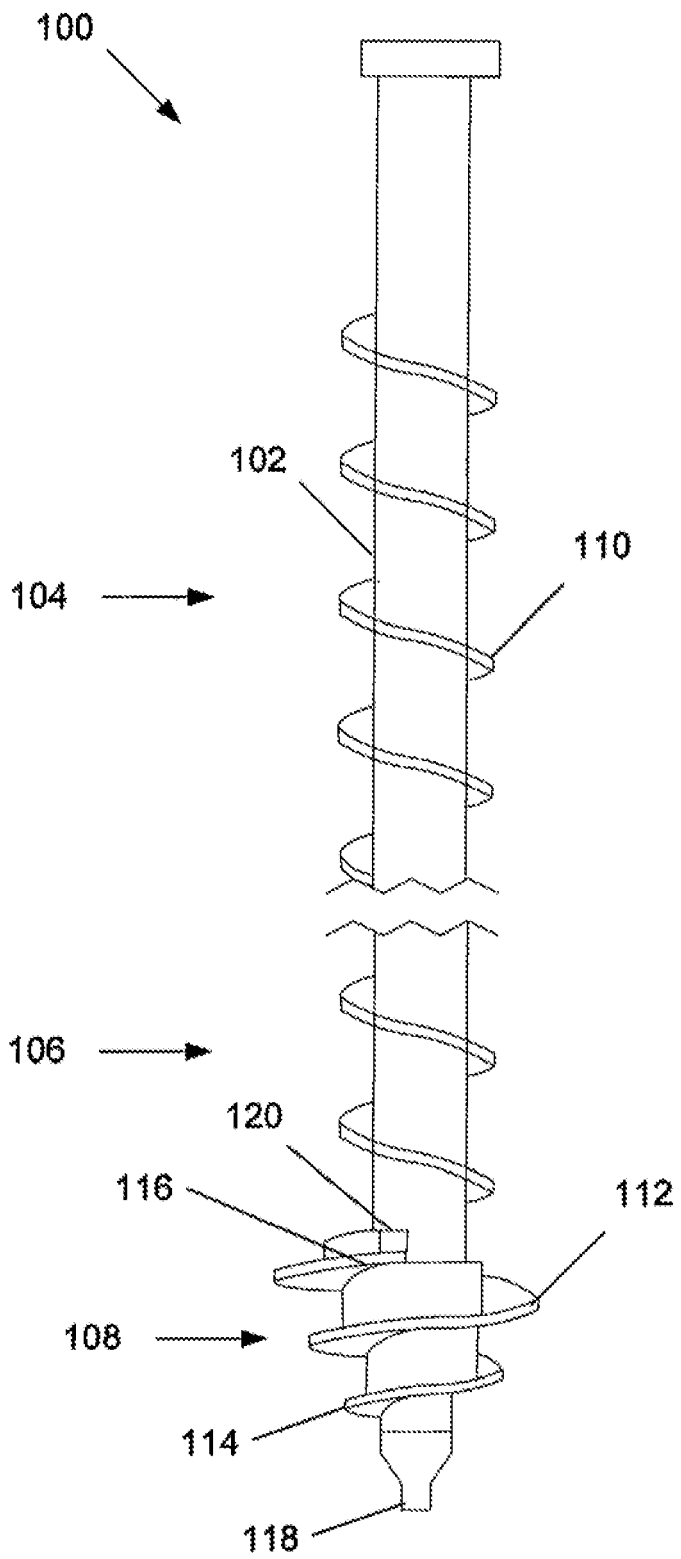
FIG. 1 is a schematic view of one embodiment of an auger grouted displacement pile.

Referring to FIG. 1, an auger grouted displacement pile 100 includes an elongated, tubular pipe 102 with a hollow central chamber 300 (see FIG. 3A), a top section 104 and a bottom section 106. The bottom section 106 includes a soil displacement head 108. The top section 104 includes an auger 110. The soil displacement head 108 has a blade 112 having a leading edge 114 and a trailing edge 116. The leading, edge 114 of the blade 112 cuts into the soil as the pile 100 is rotated and loosens the soil at such contact point. The soil displacement head 108 may be equipped with a point 118 to promote this cutting. The loosened soil passes over the blade 112 and thereafter past the trailing edge 116. The trailing edge 116 is configured to supply grout at the position where the soil was loosened. The uppermost rotation of the blade 112 includes a deformation structure 120 that displaces the soil as the blade 112 cuts into the soil.

Figure 2A:
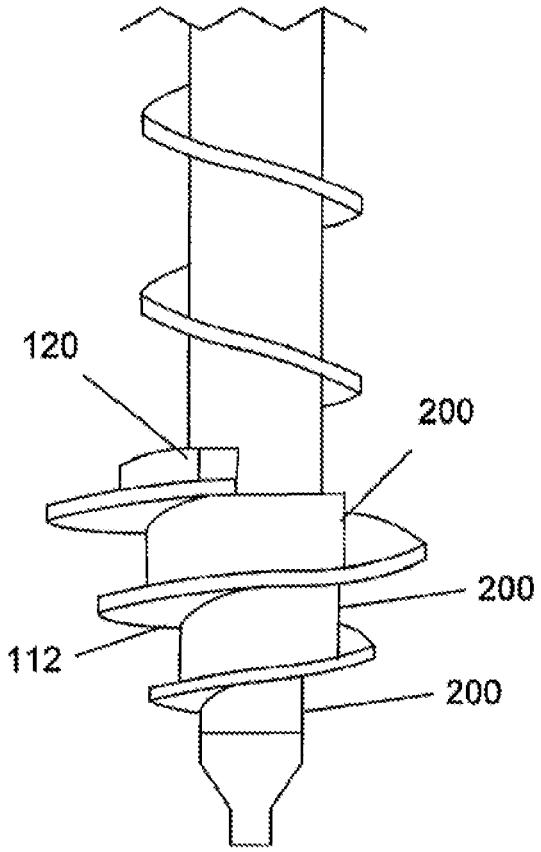
FIG. 2A and FIG. 2B are close-up views of the bottom section of a pile of the invention.
Figure 2B:
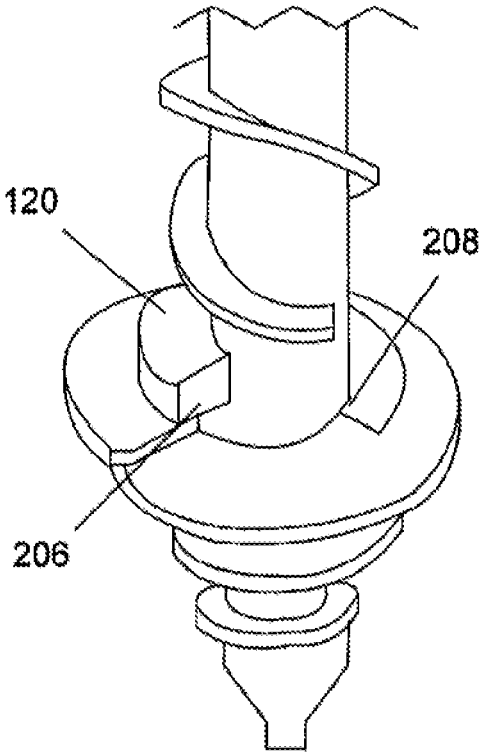

FIGS. 2A and 2B are side and perspective views of the bottom section 106. The bottom section 106 includes at least one lateral compaction element 200. In the embodiment shown in FIGS. 2A and 2B, there are three such compaction elements. The compaction element near point 118 has a diameter less than the diameter from the element near deformation structure 120. The element in the middle has a diameter that is between the diameters of the other two elements. In this fashion, the soil is laterally compacted by the first element, more compacted by the second element (enlarging the diameter of the bored hole) and even more compacted by the third element. The blade 112 primarily cuts into the soil and only performs minimal soil compaction. The deformation structure 120 is disposed above the lateral compaction elements 200. After the widest compaction element 200 has established a hole with a regular diameter, the deformation structure 120 cuts into the edge of the hole to leave a spiral pattern in the hole's perimeter or circumference.

Figure 2C:
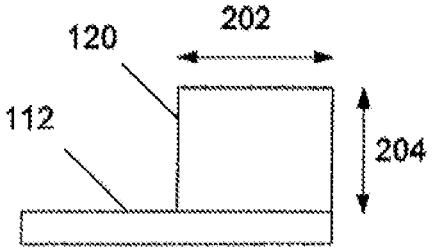
FIGS. 2C through 2J are end views of various deformation structures for use with the present invention.
Figure 2D:
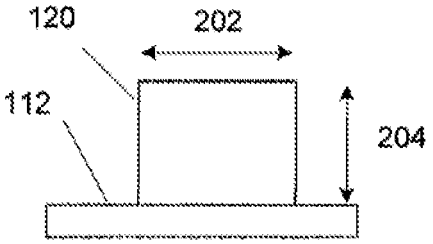
Figure 2E:
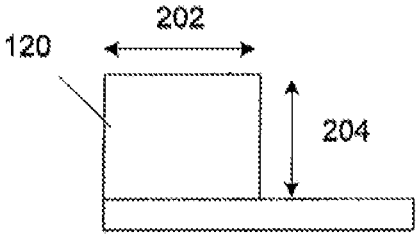
Figure 2F:
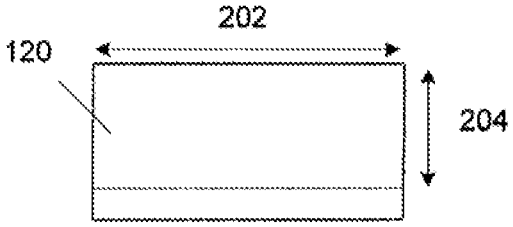
Figure 2G:
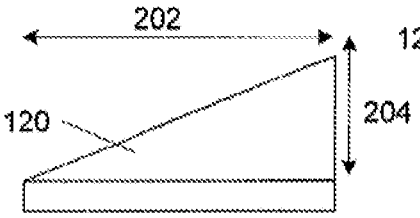
Figure 2H:
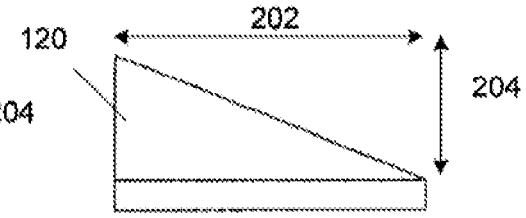
Figure 2I:
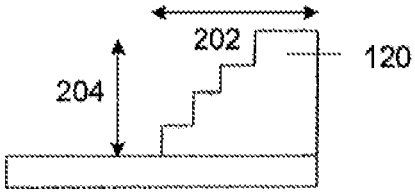
Figure 2J:
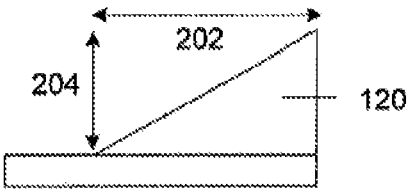

In the embodiment shown in FIGS. 2A and 2B, the deformation structure 120 is disposed on the top surface of blade 112. The deformation structure 120 shown in FIGS. 2A and 2B is shown in profile in FIG. 2C. The deformation structure 120 has a width 202 and a height 204. As can be appreciated from FIG. 2B, the height 204 changes over the length of the deformation structure 120 from its greatest height at end 206 to a lesser height at end 208 as the structure 120 coils about the tubular pipe 102 in a helical configuration. In FIG. 2B, end 206 is flush with the surface of the blade 112. It should be noted that the deformation structure shown in FIGS. 2A through 2C is only one possible deformation structure. Examples of other deformation structures are illustrated in FIGS. 2D through 2J, each of which is shown from the perspective of the end 206. For example, the deformation structure may be disposed in the middle (FIG. 2D or outside edge (FIG. 2E)) of the blade. The structure can traverse a section of the trailing edge (FIGS. 2C through 2E) or the structure may traverse the entire trailing edge (FIG. 2F). The structures need not be square or rectangular at the end 206. Angled structures (FIGS. 2G and 2H) and stepwise structures (FIGS. 2I and 2J) are also contemplated. Other suitable configurations would be apparent to those skilled in the art after benefiting from reading this specification. Advantageously, the deformation structure provides a surface for grout to grip the soil. Grout may be administered as shown in FIGS. 3A and 3B.

Figure 3A:
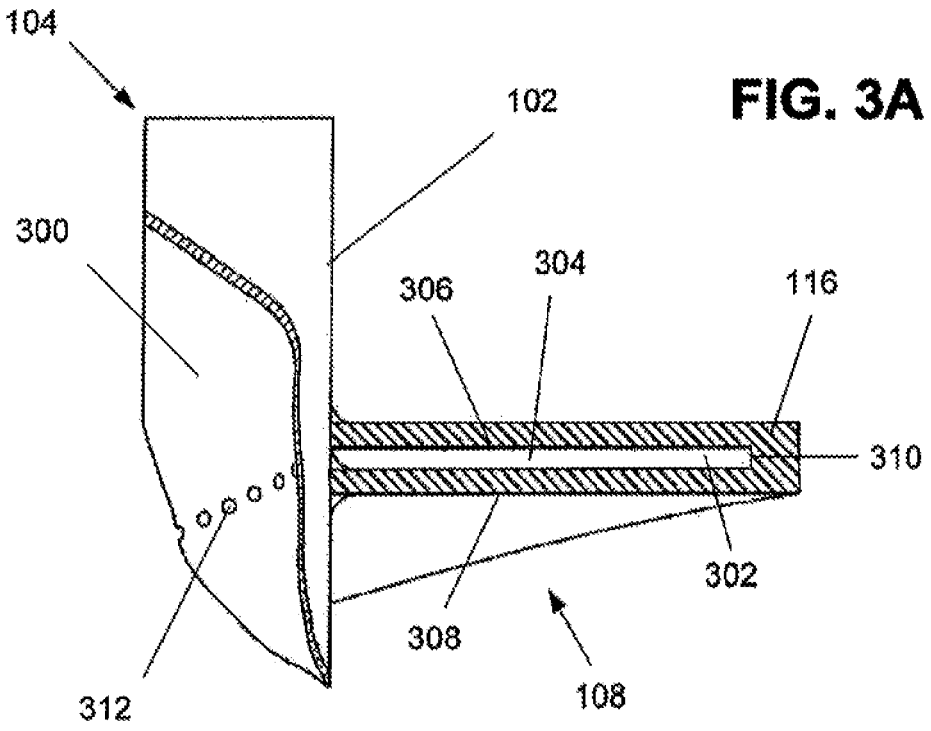
FIGS. 3A and 3B are views of a trailing edge of the invention.

FIG. 3A illustrates the trailing edge 116 of the soil displacement head 108 of FIG. 1. As shown in FIG. 3A, the soil displacement head 108 has a trailing edge 116 that includes a means 302 for extruding grout. In the embodiment depicted in FIG. 3A, the means 302 is an elongated opening 304. An elongated opening 304 is defined by parallel walls 306, 308 and a distal wall 310. The elongated opening 304 is in communication with the central chamber 300 via channels 312 in the pipe 102. Such channels 312 are in fluid communication with the elongated opening 304 such that grout that is supplied to the central chamber 300 passes through channels 312 and out the opening 304. In the embodiment shown in FIG. 3A, the channels 312 are circular holes. As would be appreciated by those skilled in the art after benefiting from reading this specification, such channels may have other configurations. For example, the channels 312 may be elongated channels, rather than individual holes. The surface of the blade 112 (not shown in FIG. 3A, but see FIG. 1) is solid such that there is no opening in the blade surface with openings only being present on the trailing edge. Advantageously, this avoids loosening soil by the action of grout extruding from the surfaces and sides of the blade. FIG. 3B shows the configuration of the opening 304 relative to the configuration of the trailing edge 116.

Figure 3B:
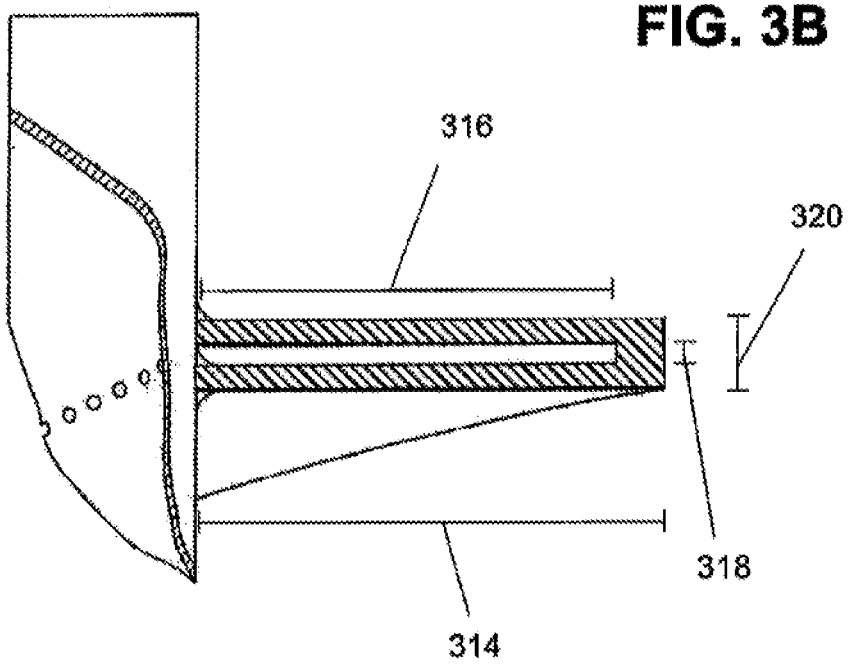

As shown in FIG. 3B, the thickness of the blade 112 is substantially equal over its entire length. In the embodiment shown in. FIG. 3B, the opening 304 is an elongated opening that, like the blade 112, has a thickness that is substantially equal over the width of such opening. In one embodiment, the opening 304 has a width 316 that is at least half the width 314 of the trailing edge 116. In another embodiment, the opening 304 has a width 316 that is at least 80% the width 308 of the trailing edge. The thickness 318 of the opening 304 likewise may be, for example, at least 25% of the thickness 320 of the trailing edge 116.

Figure 4:
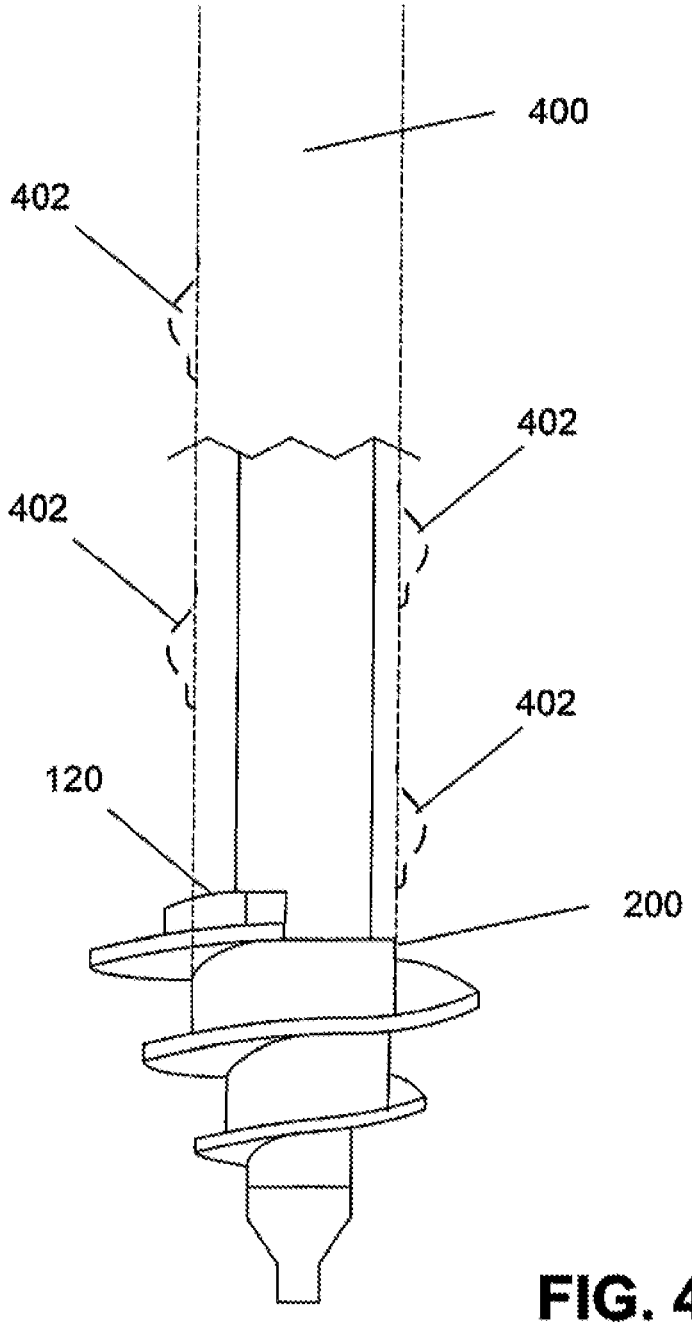
FIG. 4 is a depiction of the soil displacement caused by a pile of the invention.

FIG. 4 depicts the deformation of the soil caused by the deformation structure 120. During operation, the lateral compaction elements 200 creates a hole 400 with the diameter of the hole being established by the widest such element 200. Since the walls of the lateral compaction elements 200 are smooth, the hole established likewise has a smooth wall. The deformation structure 120 is disposed above the lateral compaction elements 200 and cuts into the smooth wall and leaves a spiral pattern cut into the soil. The side view of this spiral pattern is shown as grooves 402, but it should be understood that the pattern continues around the circumference of the hole. Grout that is extruded from the trailing edge 116 seeps into this spiral pattern. Such a configuration increases the amount of bonding between the pile and the surrounding soil. The auger 110 of the top section 102 (see FIG. 1) does not extrude grout. Rather, the auger 110 provides lateral surfaces that grip the grout after it has set. The diameter of the auger 110 is generally less than the diameter of the blades 112 since the auger is not primarily responsible for cutting the soil, but rather, insuring that the grout column is complete and continuous by constantly augering the grout downward into the voids created by the deformation structure and the lateral displacement element. The flanges that form the auger 110 have, in one embodiment, a width of about two inches.

The blade 112 has a helical configuration with a handedness that moves soil away from the point 118 and toward the top section where it contacts the lateral compaction element 200. The auger 110, however, has a helical configuration with a handedness opposite that of the blades 112. The handedness of the auger helix pushes the grout that is extruded from the trailing edge 116 toward the bottom section. In one embodiment, the auger 110 has a pitch of from about 1.5 to 2.0 times the pitch of the blade 112. The blade 112 may have any suitable pitch known in the art. For example, the blade 112 may have a pitch of about three inches. In another embodiment, the blade 112 may have a pitch of about six inches.

Figure 5A:
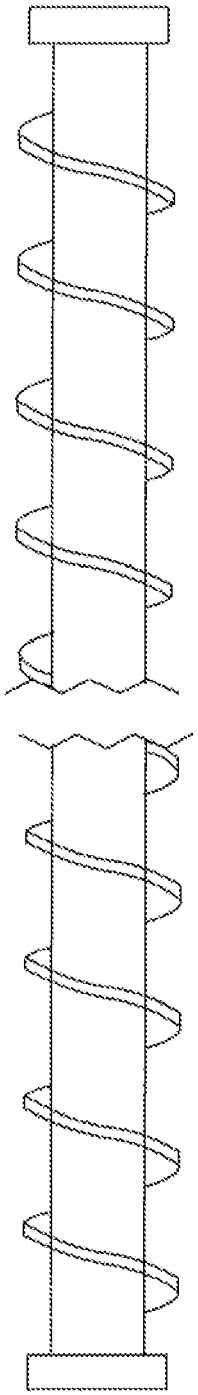
FIGS. 5A and 5B are illustrations of two supplemental piles that may optionally be attached to the auger grouted displacement pile.
Figure 5B:
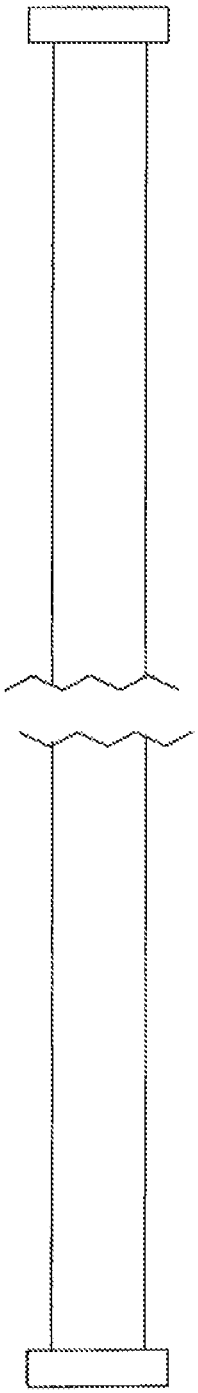

FIGS. 5A and 5B are depictions of two piles that may be used in conjunction with the auger grouted displacement pile of FIG. 1. FIG. 5A depicts a pile 500 with an auger section 502 similar to those described with regard to FIG. 1. Such a pile may be connected to the pile of FIG. 1. FIG. 5B is a pile 504 that lacks the auger: its surface 506 is smooth. In some embodiments, one or more auger-including piles are topped by a smooth pile such as the pile depicted in FIG. 5B. This smooth pile avoids drag-down in compressive soils and may be desirable as the upper most pile.

Figure 6:
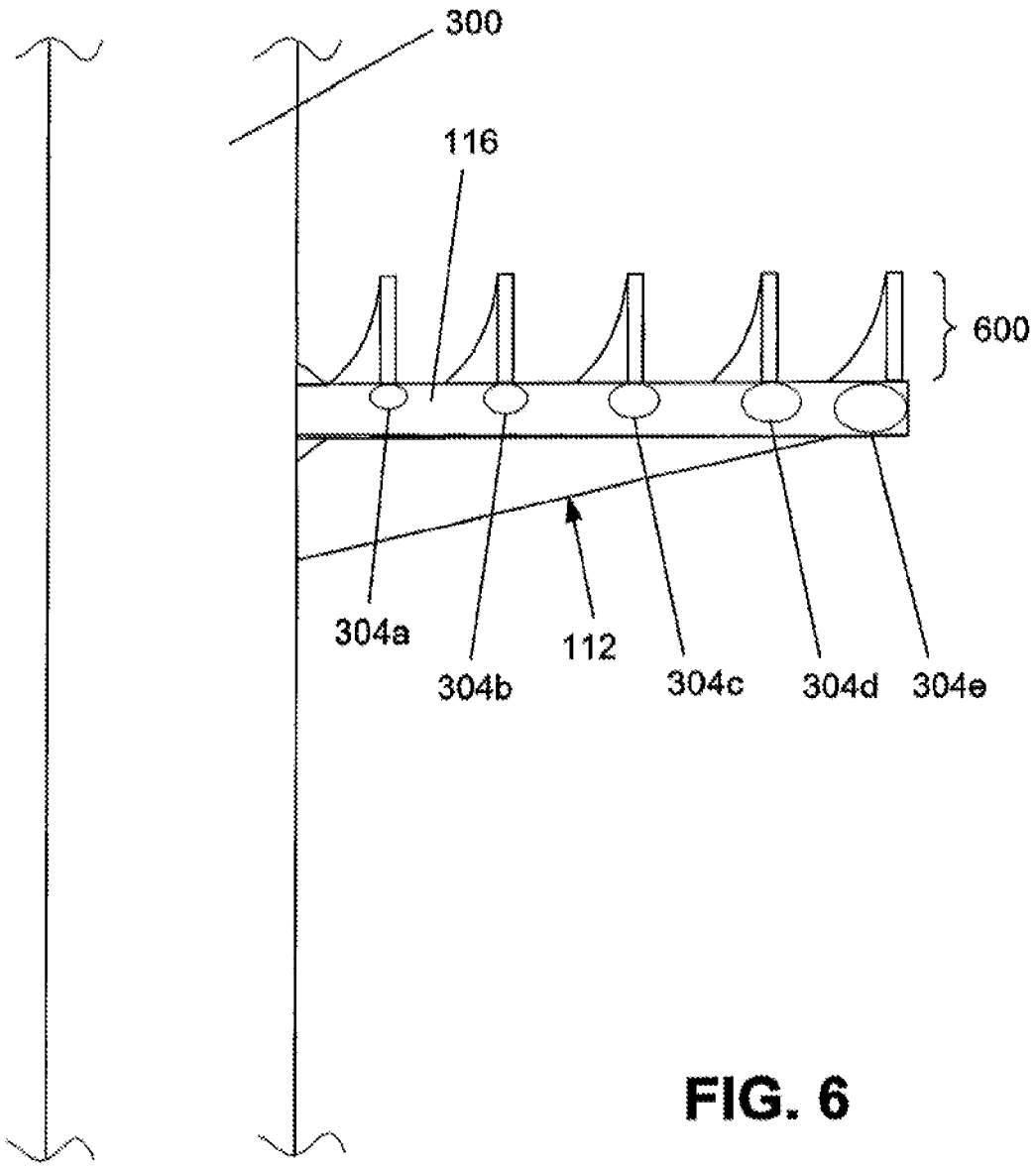
FIG. 6 is a depiction of one grout delivery system of the invention.

FIG. 6 is a close-up view of a soil displacement head 108 that includes a plurality of mixing fins 600. Mixing fins 600 are raised fins that extend parallel to one another over the surface of the blade 112. The fins 600 mix the grout that is extruded out of openings 304*a*-304*e* with the surrounding soil as the extrusion occurs. The mixing of the grout with the surrounding soil produces a grout/soil layer that is thicker than the trailing edge 116 and, in some embodiments, produces a single column of solidified grout/soil.

Referring again to FIG. 6, the trailing edge 116 has several openings 304*a*-304*e* which are in fluid communication with the central chamber 300. To ensure grout is delivered evenly from all of the openings, the opening diameters are adjusted so that grout is easily extruded from the large openings (such as opening 304*e*) while restricting the flow of grout from the small openings (such as opening 304*a*). Since the opening 304*a* is near the central chamber 300, the grout is extruded with relatively high force. This extrusion would lower the rate at which grout is extruded through the openings that are downstream from the opening 304*a*. To compensate, the diameters of each of the openings 304*a*-304*e* increases as the opening is more distant from the central chamber 300. In this manner, the volume of grout extruded over the length of the trailing edge 116 is substantially even. In one embodiment, the grout is forced through the pile with a pressurized grout source unit. In another embodiment, the grout is allowed to flow through the system using the weight of the grout itself to cause the grout to flow. In one embodiment, the rate of extrusion of the grout is proportional to the rate of rotation of the pile.

Figure 7A:
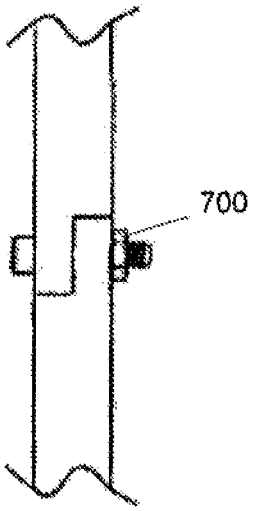
FIG. 7A Prior Art
FIGS. 7A, 7B and 7C are side views of conventional pile couplings according to the prior art.
Figure 7B:
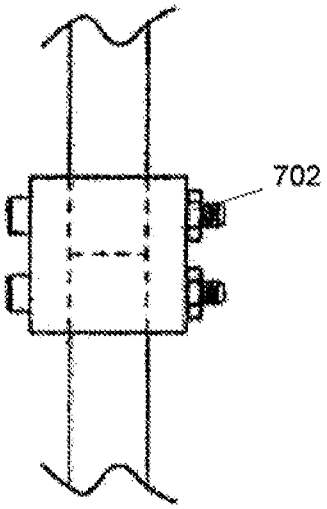
FIG. 7B Prior Art
Figure 7C:
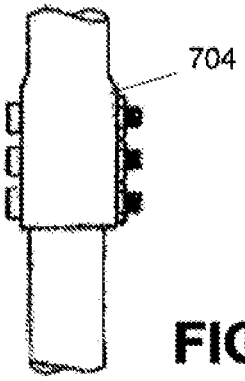
FIG. 7C Prior Art

Referring to FIGS. 8, 9, 10A, and 10B, there is shown a pile assembly with a specific pile coupling. Conventional coupling piles 700, 702 or 704 may also be used (see FIGS. 7A to 7C). The assembly 800 includes two pile sections 802*a* and 802*b*, each of which is affixed to or integral with a respective flange 804*a* and 804*b*. Although only portions of the pile sections 802*a* and 802*b* and one coupling are shown, the assembly 800 may include any number of pile sections connected in series with the coupling of the present invention.

The flanges 804*a* and 804*b* each include a number of clearance holes 1000 spaced apart on the flanges such that the holes 1000 line up when the flame 804*a* is abutted against the flange 804*b*. The abutting flanges 804*a* and 804*b* are secured by fasteners 806, such as the bolts shown in FIG. 8, or any other suitable fastener. The fasteners 806 pass through the holes 1000 such that they are oriented in a direction substantially parallel to the axis of the pile. In one embodiment, shown in FIG. 10A, the flange 804*a* includes six (6) spaced holes 1000. In another embodiment, shown in FIG. 10B, the flange 804*a* includes eight (8) spaced holes 1000. The eight-hole embodiment allows more fasteners 806 to be used for applications requiring a stronger coupling while the six-hole embodiment is economically advantageous allowing for fewer, yet evenly-spaced, fasteners 806.

In another embodiment, the flanges 804*a*, 804*b* are in each in a plane that is substantially transverse to the longitudinal axis of the pile sections 802*a*, 802*b*. Particularly, at least one surface, such as the interface surface 900 (FIG. 9) extends in the substantially transverse plane. Further, the flanges 804*a*, 804*b* are slender and project a short distance from the pile sections 802*a*, $02*b* in the preferred embodiment. This minimizes the interaction of the flanges 804*a*, 804*b* with the soil.

The vertical orientation of the fasteners allows the pile sections 802*a*, 802*b* to be assembled without vertical slop or lateral deflection. Thus the assembled pile sections 802*a*, 802*b* support the weight of a structure as well as upward and horizontal forces, such as those caused by the structure moving in the wind or due to an earthquake. Further, because the fasteners 806 are vertically oriented, an upward force is applied along the axis of the fasteners 806. Fasteners tend to be stronger along the axis than under shear stress.

In a particular embodiment, the pile sections 802*a* acid 802*b* are about 3 inches in diameter or greater such that the piles support themselves without the need for grout reinforcement, though grout or another material may be used for added support as desired. Since the flanges 804*a*, 804*b* may cause a gap to form between the walls of the pile sections 802*a*, 802*b* and the soil as the pile sections 802*a*, 802*b* are driven into the soil, one may want to increase the skin friction between the pile sections 802*a*, 802*b* and the soil for additional support capacity for the pile assembly 800 by adding a filler material 808 to fill the voids between the piles and the soil. The material 808 may also prevent corrosion. The material 808 may be any grout, a polymer coating, a flowable fill, or the like. Alternatively, the assembly 800 may be used with smaller piles, such as 1.5 inch diameter pile sections, which may be reinforced with grout. The pile sections 802*a*, 802*b* may be made from any substantially rigid material, such as steel or aluminum. One or more of the pile sections in the assembly 800 may be helical piles.

Figure 11:
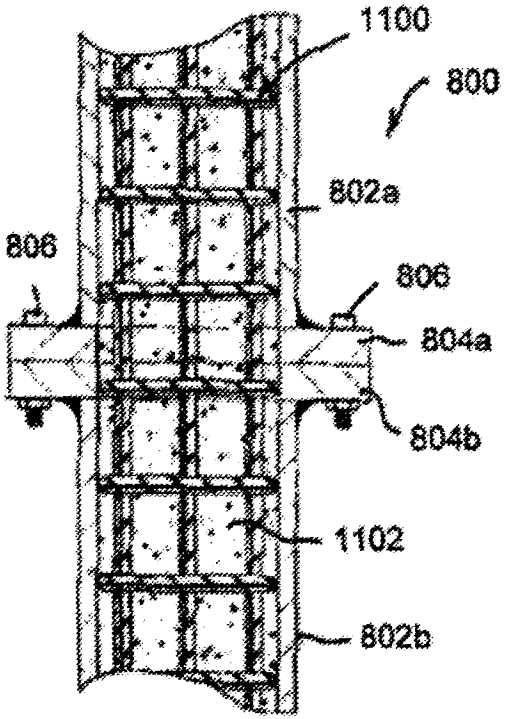
FIG. 11 is a cross-sectional side view of a pile coupling with internal grout and an inserted rebar cage according to an embodiment of the present invention.

In a particular embodiment, the pile sections 802*a*, 802*b* are tubes having a circular cross-section, though any cross-sectional shape may be used, such as rectangles and other polygons. A particular advantage of the present invention over conventional pile couplings is that the couplings in the assembly 800 do not pass the fasteners 806 through the interior of the pile tube. This leaves the interior of the assembled pile sections open so that grout or concrete may be easily introduced to the pile tube along the length of all the assembled pile sections. Further, a reinforcing structure, such as a rebar cage that may be dropped into the pile tube, may be used with the internal concrete FIG. 11 shows such a cage 1100 with internal grout 1102 providing a particularly robust pile assembly 800.

Figure 12:
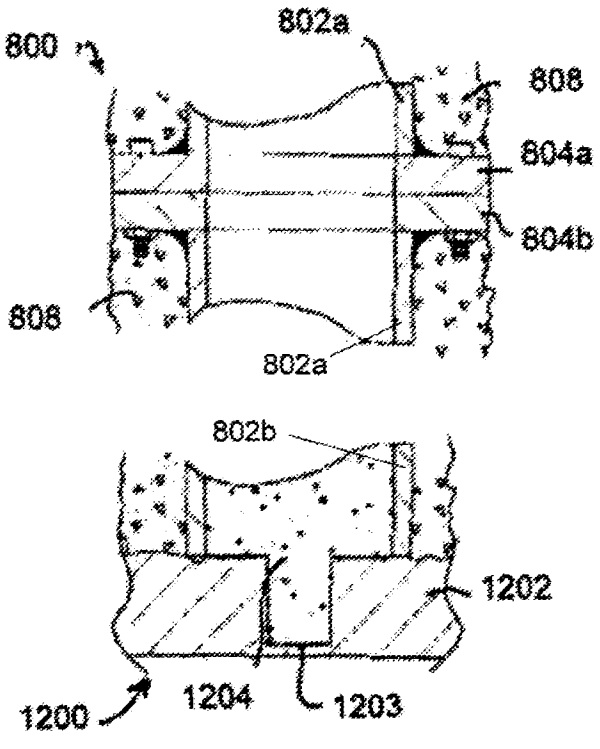
FIG. 12 is a cross-sectional side view of a pile coupling with a rock socket according to an embodiment of the present invention.

In a further particular embodiment, the invention is used in conjunction with a rock socket. As shown in FIG. 12, the rock socket 1200 is formed by driving the pile sections into the ground and assembling them according to the invention until the first pile section hits the bedrock 1202. A drill is passed through the pile tube to drill into the bedrock 1202, forming a hole 1203, and then concrete 1204 is introduced into the pile tube to fill the hole in the bedrock and at least a portion of the pile tube. This provides a strong connection between the assembled pile sections and the bedrock 1202.

Figure 8:
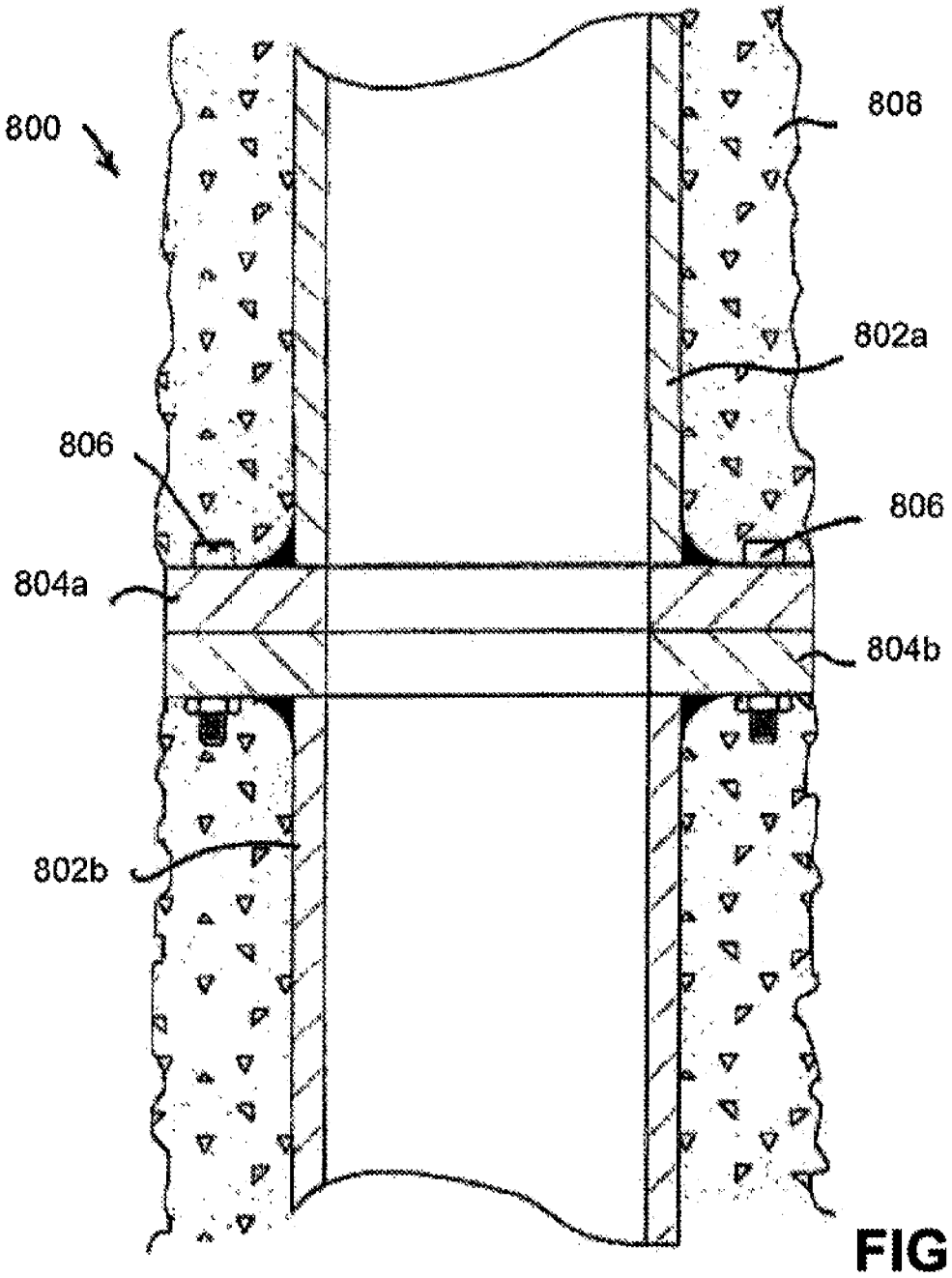
FIG. 8 is a cross-sectional side view of a pile assembly having a pile coupling according to the present invention.
Figure 9:
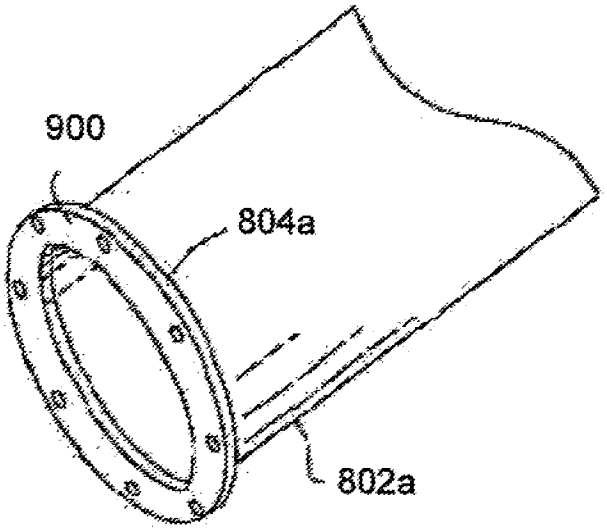
FIG. 9 is an isometric view of the end of a pile section and flange of FIG. 8 and FIGS. 10A and 10B are end views of pile sections and flanges according to the present invention.
Figure 10A:
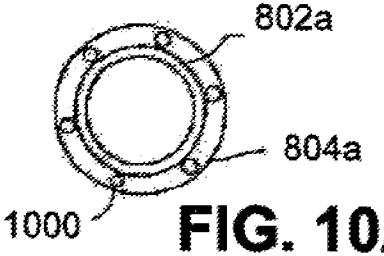
Figure 10B:
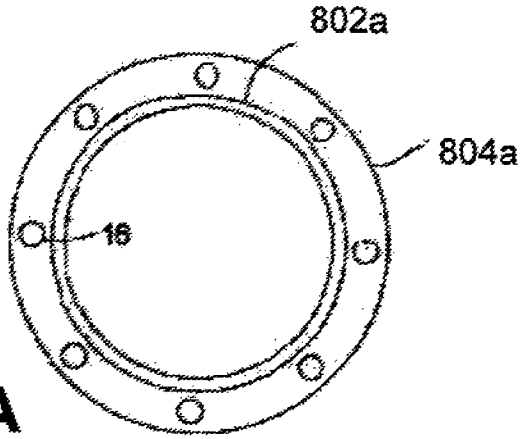
Figure 13:
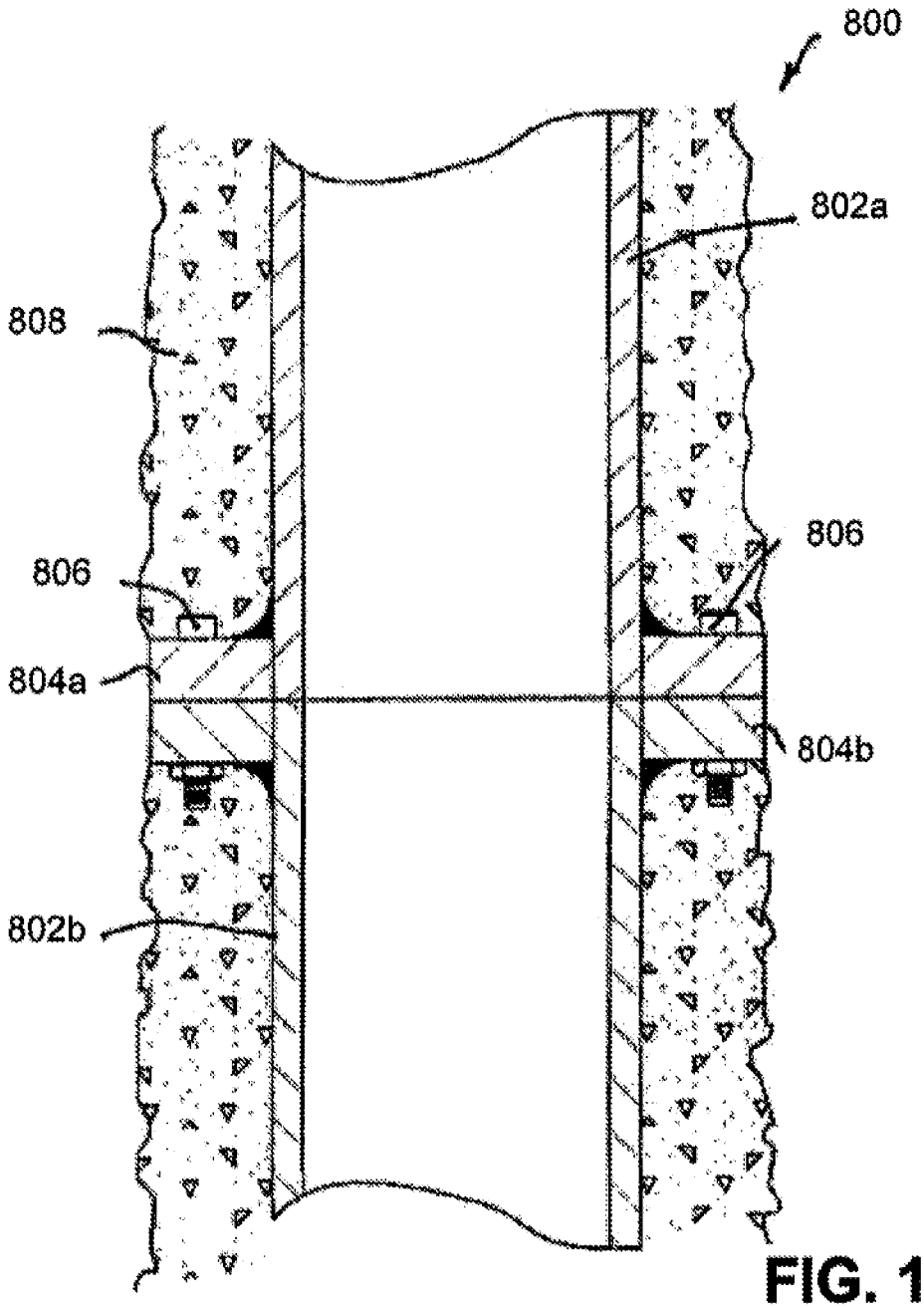
FIGS. 13, 14 and 15 are cross-sectional side views of pile assemblies having alternative pile couplings according to the present invention.
Figure 14:
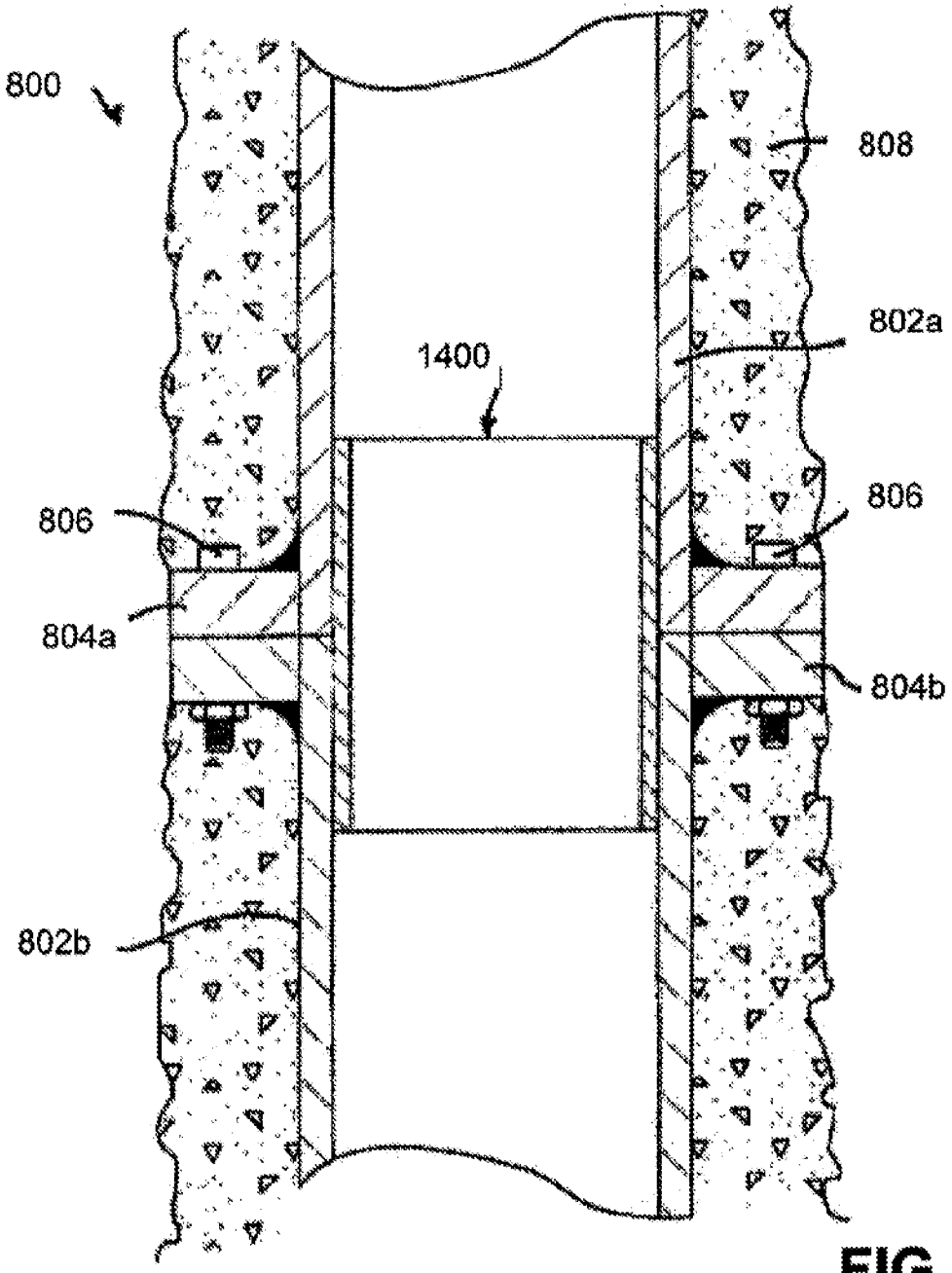

In an alternative configuration of the pile assembly 800, the flanges 804*a*, 804*b* are welded to or formed in the outer surface of the respective pile sections 802*a*, 802*b* as shown in FIG. 13 as opposed to the ends of the pile sections as shown in FIG. 8. This allows the pile sections 802*a*, 802*b* to abut one another and thus provide a direct transfer of the load between the pile sections in a further alternative configuration a gasket or o-ring is used to make the pile watertight. This has a particular advantage when passing through ground water or saturated soils. This feature keeps the interior of the pile clean and dry for the installation of concrete or other medium. This feature also provides a pressure tight conduit for pressurized grout injection through the pile and into the displacement head or any portion of the pile shaft that it is deemed most advantageous to the pile design. In a further alternative configuration, an alignment sleeve 1400 is included at the interface of the pile sections 802*a*, 802*b* as shown in FIG. 14. The alignment sleeve 1400 is installed with an interference fit, adhesive, welds, equivalents thereof, or combinations thereof. The alignment sleeve 1400 may be used with any of the embodiments described herein.

Figure 15:
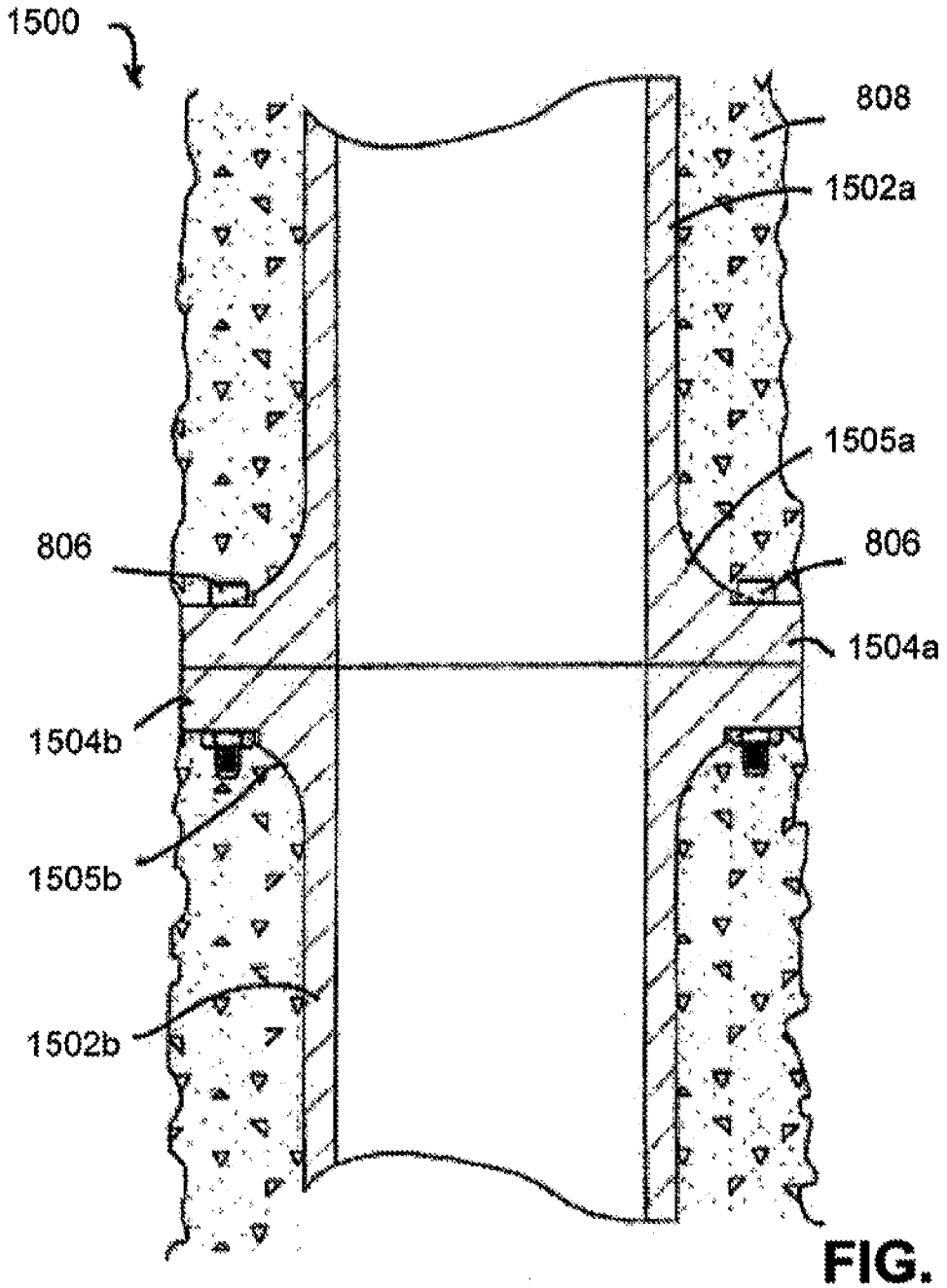

A pile assembly 1500 having an alternative coupling is shown in FIG. 15. The assembly 1500 includes pile sections 1502*a* and 1502*b* having integral filleted flanges 1504*a* and 1504*b*. The fillets 1505*a*, 1505*b* provide a stronger coupling and potentially ease the motion of the pile sections through soil. Similarly to the previous embodiments, the flanges 1504*a*, 1504*b* include several clearance holes for fasteners 806, and the assembly 1500 may be coated with or reinforced by a grout or other material 808.

Figure 18:
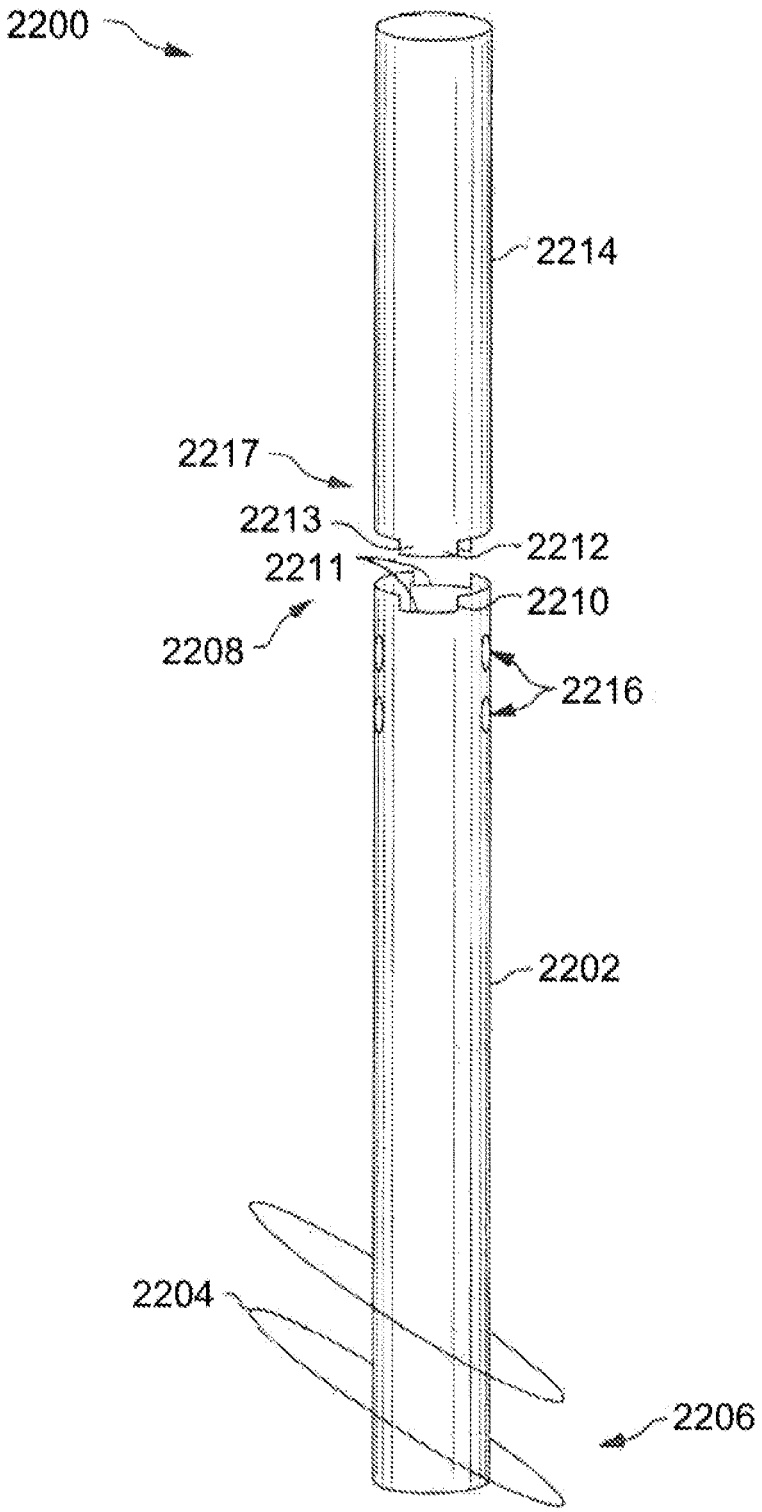
FIG. 18 is a partial perspective view of a torqued in pile assembly in accordance with an embodiment, partially assembled, the pile including first and second pile sections with each of the pile sections including mated fittings at engageable ends forming a pile coupling with improved torsion transfer.

With reference to FIGS. 16-21 and FIGS. 26(*a*)-26(*c*), the following portion of this discussion relates to a torqued-in pile in accordance with certain embodiments and more specifically other pile couplings. It will be noted that the inventive concepts are effective whether the pile is a helical pile having flighting, a bored in pile or a torqued down pile. As shown in FIG. 18, a pile assembly 2200 is provided that includes a first pile section 2202 and a second pile section 2214. Each of the first and second pile sections 2202, 2214 according to this embodiment are defined by hollow pile shafts, each pile section being made from steel, aluminum or other suitable material.

The first pile section 2202 according to this embodiment includes a driving tip 2204 formed at a distal end 2206 that is configured to be driven into a supporting surface (not shown) such as soil, rocks, etc. An opposing proximal end 2208 of the first pile section 2202 includes a first mated fitting 2210 that is monolithically formed in a circumference of the proximal end 2208. In the example of FIG. 18, the first mated fitting 2210 is preferably defined by a set of precision cuts extending monolithically along the circumference that are sized and configured to match those that are formed as part of a corresponding mated fitting 2212 of the second pile section 2214, the latter fitting 2212 being formed on the distal end 2217 of the second pile section 2214. More specifically and when engaged, the mated fittings 2210, 2212, as configured, produce or create an interlocking fit between the first and second pile sections 2202, 2214. The types of cuts and the degree of irregularity of the cuts provided in each mated fitting 2210, 2212 can be varied provided an interlocking fit is created between the pile sections 2202, 2214 (and also any succeeding pile sections not shown in this view) sequentially added to the second pile section 2214. Preferably, the cuts used to create the mated fittings 2210, 2212 are formed using precision cutting apparatus. The presently depicted version represents the cuts as matching recesses 2211 and axial projections or teeth 2213, but the formed cuts can be suitably angled and spacially distributed, as needed. Alternative versions are shown, for example, in FIGS. 26(*a*)-26(*c*), as discussed below.

According to this embodiment, the proximal end 2208 further comprises at least one through hole 2216 that extends through the diameter of the first pile section 2202. More specifically and according to this embodiment, two sets of through-holes 2216 are present in spaced relation proximate the proximal end 2208 of the first pile section 2202.

Figure 19:
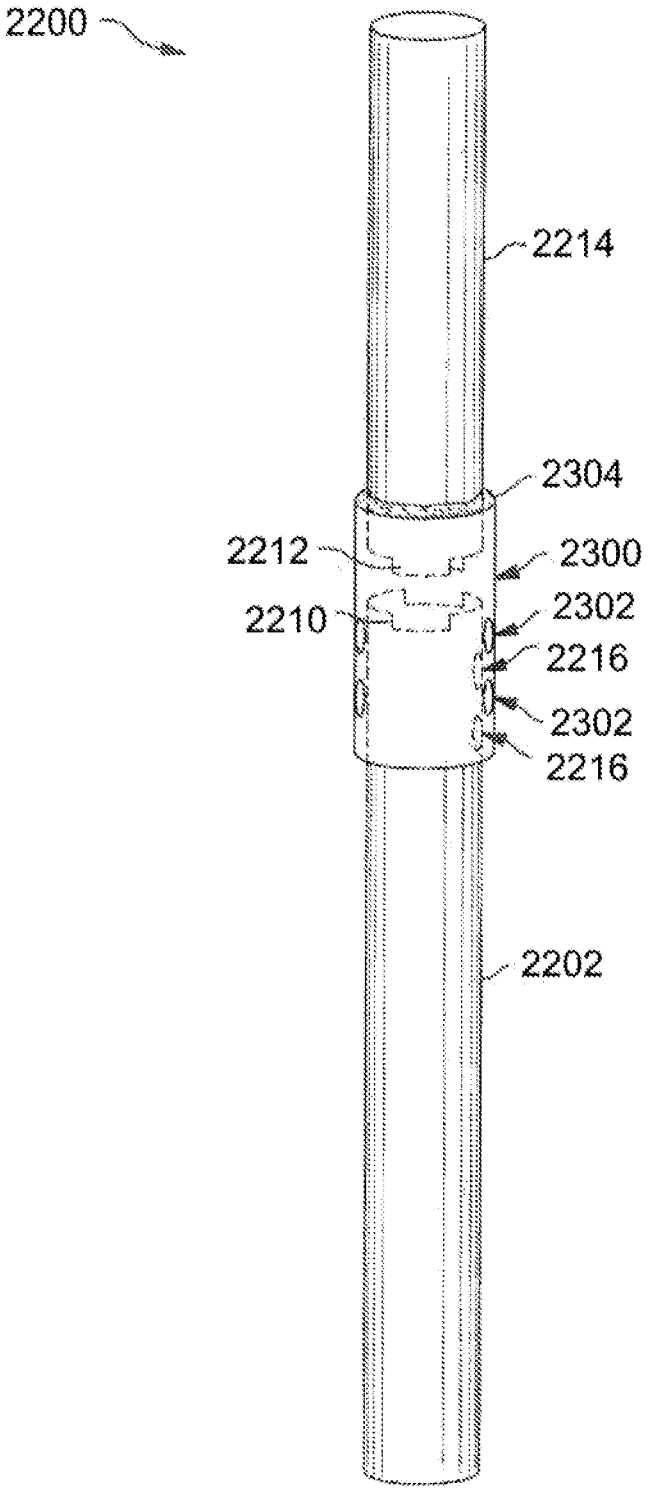
FIG. 19 is the perspective view of the pile of FIG. 18, still in the partially assembled condition, further depicting a sleeve overlapping the engageable ends of the first and second pile sections.

As shown in FIG. 19, a sleeve 2300 is disposed about the connection point of the first and second pile sections 2202, 2214. For illustrative purposes, the first pile section 2202 and the second pile section 2214 are shown in this figure in an un-connected state though the sleeve 2300 is attached following their engagement. According to this embodiment, the sleeve 2300 is a hollow cylindrical section made from steel, aluminum or other suitable structural material that is sized to axially overlay the proximal end 2208 of the first pile section 2202 and the engaged distal end 221 of the second pile section 2214 as part of the overall pile coupling. The sleeve 2300 further includes at least one set of corresponding through-holes 2302. For purposes of assembly, the sleeve 2300 includes two sets of through-holes 202 which are configured and spaced to be aligned with the two sets of through-holes 2216 formed on the first pile section 2202. A bolt or other fastening member (not shown) is inserted through each aligned sets of through-holes 2216, 2302. A weld 2304 is preferably used to attach the sleeve 2300 to the second pile section 2214 although it should be noted that other forms of securement can be utilized. In some embodiments, a second weld (not shown) may also be used to attach the sleeve 2300 to the first pile section 2202.

In operation and when a torque is applied to the coupled pile assembly 2200, the torsional load is adequately supported by the bolt(s), the weld(s) 2304, as well as the mated pile sections 2202, 2214 due to the inclusion of the sleeve 2300 and the interlocking fit created by the mated fittings 2210, 2212.

Figure 20:
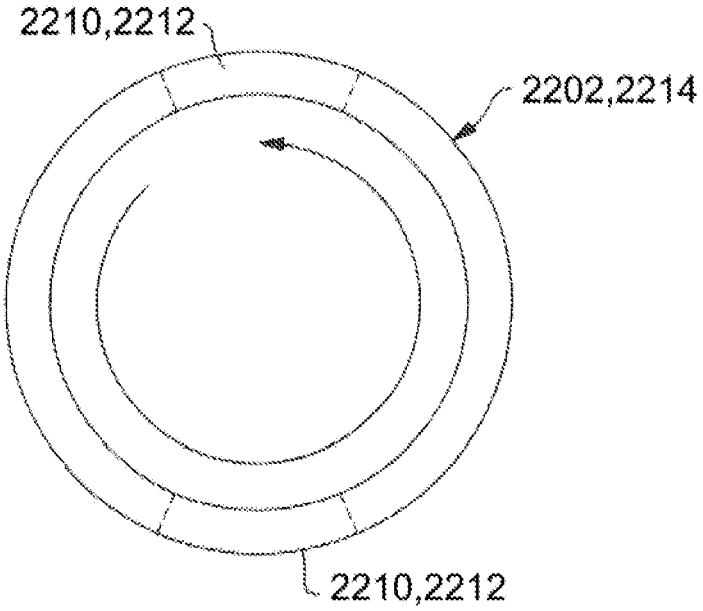
FIG. 20 is a sectioned end view of the pile depicting the engaged ends of the first and second pile sections of the pile coupling of FIGS. 18 and 19.
Figure 21:
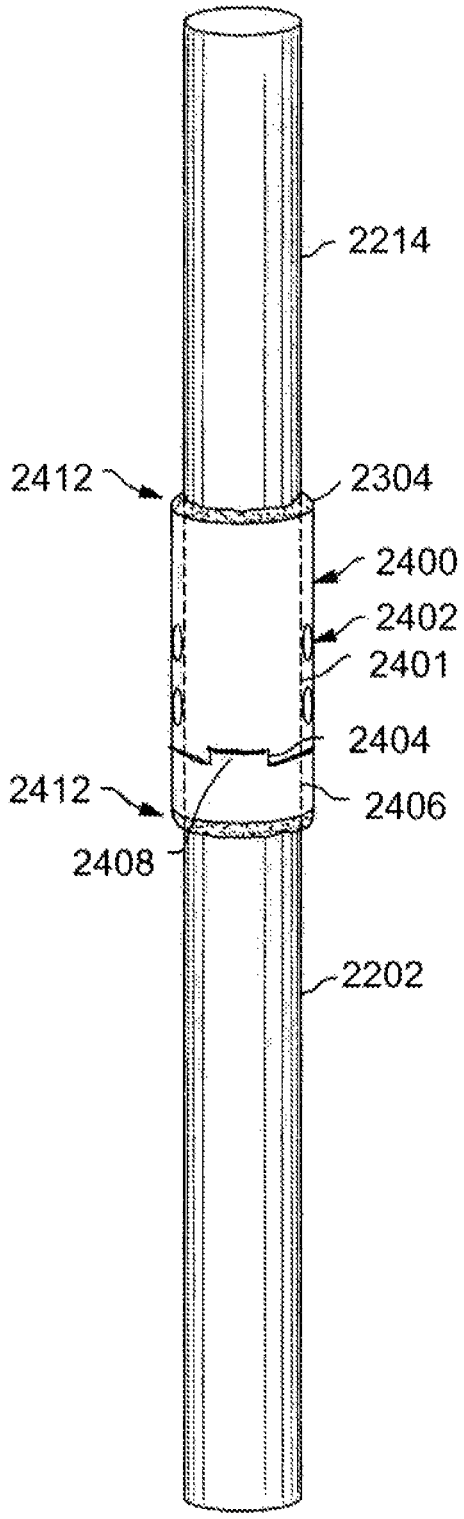
FIG. 21 is a perspective view of another torqued in pile made in accordance with another embodiment.

The interlocking configuration between the first and second pile sections 2202, 2214 provides additional strength and enables better distribution of torsional loads during the pile installation, as shown in the end view of FIG. 20.

Other embodiments that embody the inventive concepts are possible. A second embodiment is described with reference to FIG. 21. For the sake of clarity, the same reference numbers are used for like parts. In this embodiment, a first pile section 2202 and a second pile section 2214 are provided. Unlike the prior embodiment, the engaged ends of the first pile section 2202 and the second pile section 2214 do not include mated fittings and in which the ends of the pile sections are maintained in abutting relation. A sleeve 2400 is assembled in overlaying fashion to the first and second pile sections 2202 and 2214, respectively. According to this embodiment, the sleeve 2400 is a hollow substantially cylindrical component that comprises a first sleeve or coupler portion 2401 and a second sleeve or coupler portion 2406. The first sleeve portion 2401 includes at least set of through holes 2402 and a mated fitting 2404 at one end. In addition, the first sleeve portion 2401 has a pair of spaced sets of through holes 2402 that are aligned with the through holes 2216 of the first pile section 2202 in a manner previously discussed wherein each through hole 2216, 2402 is sized to receive a threaded or riveted connector (not shown).

The second sleeve portion 2406 has a corresponding mated fitting 2408 that engages the mated fitting 2404 defined on the engaged end of the first sleeve portion 2401 and creates an interlocking fit therebetween, in a manner akin to that between the first and second pile sections 2202, 2214 of the prior embodiment. Preferably, the mated fittings 2404, 2408 are defined by precision cuts monolithically made in the circumference at the engaged ends of each sleeve portion 2401, 2406. In terms of the cuts made, the shape of irregularity of the mated fittings 2404, 2408 may be varied, with the intent of the formed connection being to transfer torque and relieve the fasteners of the majority of the stress created during installation of the pile as a result of the interlocking fit. The second and first sleeve portions 2406, 2401 are attached to the first pile section 2202 and second pile section 2214, respectively, by welds. In operation, the interlocking sleeve portions 2401, 2406 act to better distribute the torsional load applied to the pile sections 2202, 2214.

Figures 16, 17:
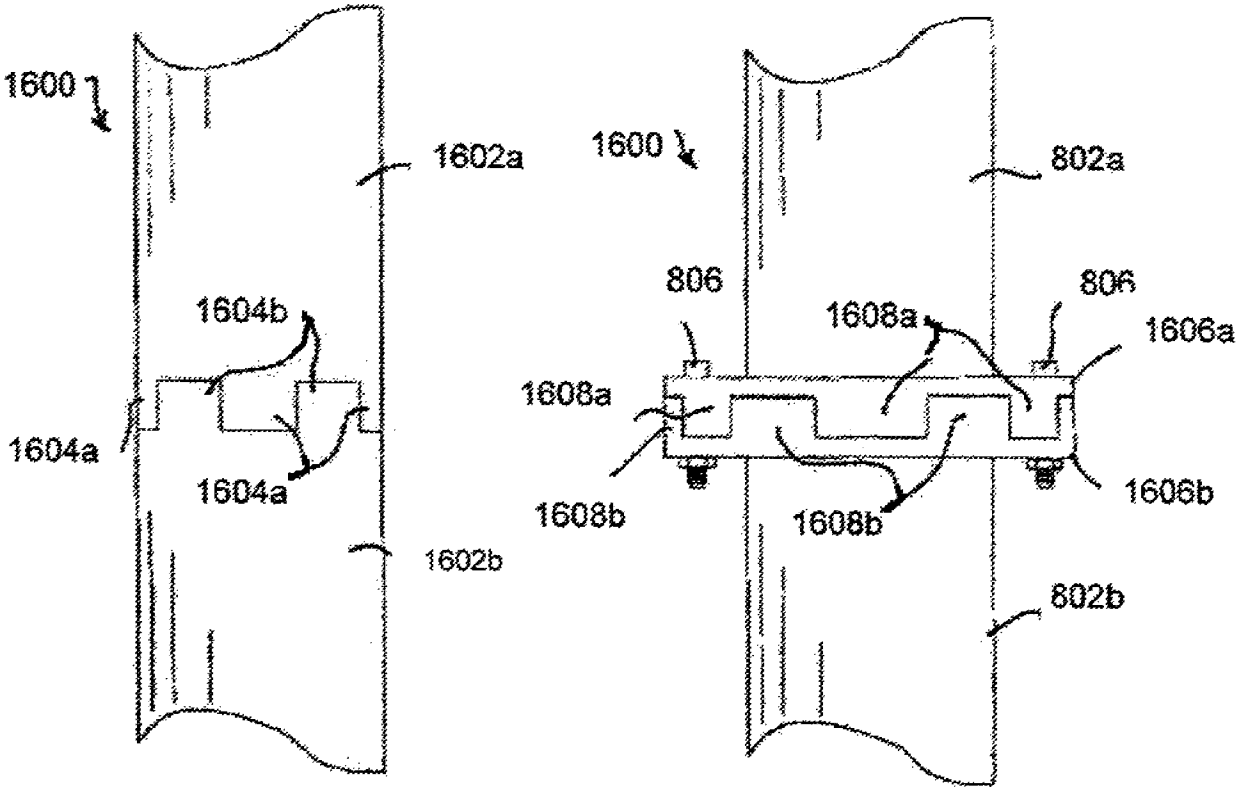
FIGS. 16 and 17 are side views of pile assemblies having alternative pile couplings with improved torsion transfer according to the present invention.

In a further alternative embodiment shown in FIGS. 16 and 17, the pile assembly 1600 includes a coupling or sleeve between the pile sections 1602*a*, 1602*b* with torsion resistance. In FIG. 6, the flanges are omitted for simplicity. The pile sections 1602*a*, 1602*b* include respective teeth 1604*a* and 1604*b* that interlock to provide adjacent surfaces between the pile sections 1602*a*, 1602*b* that are not perpendicular to the longitudinal axis of the pile sections. (While teeth having vertical walls are shown, teeth with slanted or curved walls may be used.) The teeth 1604*a*, 1604*b* may be integrally formed with the respective pile sections 1602*a*, 1602*b*. Alternatively, the teeth may be affixed to the respective pile sections. In FIG. 16, the flanges 1606*a*, 1606*b* are shown with respective interlocking teeth 1608*a*, 1608*b*. The teeth 1608*a*, 1608*b* may be integrally formed with the respective flanges 1606*a*, 1606*b*. Alternatively, the teeth may be affixed to the respective flanges. The flanges 1606*a*, 1606*b* (see FIG. 17) may be used with pile sections 802*a*, 802*b* according to the first embodiment, pile sections 1602*a*, 1602*b* having teeth 1604*a*, 1604*b*, or other pile sections. In the previous embodiments, any twisting forces on the pile sections, which would be expected especially when one or more of the pile sections is a helical pile, are transferred from one pile to the next through the fasteners 806. This places undesirable shear stresses on the fasteners 806. The interlocking teeth of the present embodiment provide adjacent surfaces between the pile sections that transfer torsion between the pile sections to thereby reduce the shear stresses on the fasteners 806.

Figure 26A:
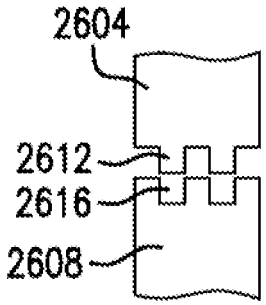
FIGS. 26(*a*)-26(*c*) illustrate partial elevational comparative views of pile couplings akin to those of FIGS. 16-21 that are made in accordance with other exemplary embodiments.
Figure 26B:
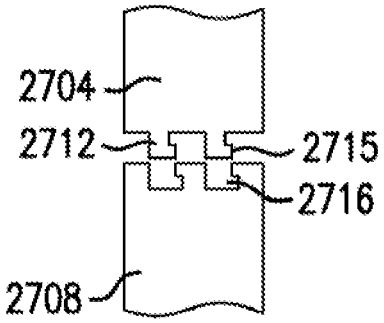
Figure 26C:
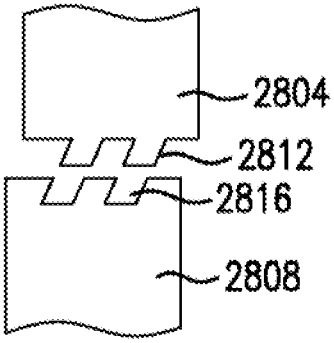

It will be readily apparent that the interlocking fit of either the sleeve portions or the pile sections a suitable pile coupling as described by the preceding embodiments can assume a number of configurations as further shown, for example, in FIGS. 26(*a*)-(*c*). FIG. 26(*a*) depicts a sectional representation of a pair of pile sections 2604, 2608 (or sleeve portions) each having a plurality of spaced projections or teeth 2612 disposed about the circumference at respective mating ends. According to this embodiment, the teeth 2612 of each mating section 2604, 2608 engage corresponding recesses 2616 to create an interlocking and torque resistant fit.

Another exemplary embodiment is illustrated in FIG. 26(*b*), again representative of either the pile sections 2704, 2708 (or sleeve portions) of a coupler in which each of the axial projections or teeth 2712 are circumferentially spaced about the periphery of each mating end. According to this embodiment, the teeth 2712 have a shape that is essentially rectangular with the exception of a lateral end feature 2715 that is sized to engage a corresponding groove or recess 2716 formed in the mating portion in order to create an interlocking connection.

According to yet another variation shown in FIG. 26(*c*), the projections or teeth 2812 and the corresponding recesses 2816 in the mating pile portions 2804, 2808 (or sleeve portions of the coupling) can be angled relative to the primary axis of the pile shaft to create a more torque resistant connection. A preferred angle is about 20-30 degrees, though this feature can be suitably varied as needed.

In each of the above examples as well as those previously discussed, the sleeve portions can be attached to the pile shaft using any known attachment technique, including but not limited to welding, epoxying and fasteners.

It should be noted that the manifold connections in the above-described embodiments each provide a continuous plane along the length of the assembled pile sections allowing for neither lateral deflection nor vertical compression or tension loads. It should be further noted that features of the above-described embodiments may be combined in part or in total to form additional configurations and embodiments within the scope of the invention.

Figure 22:
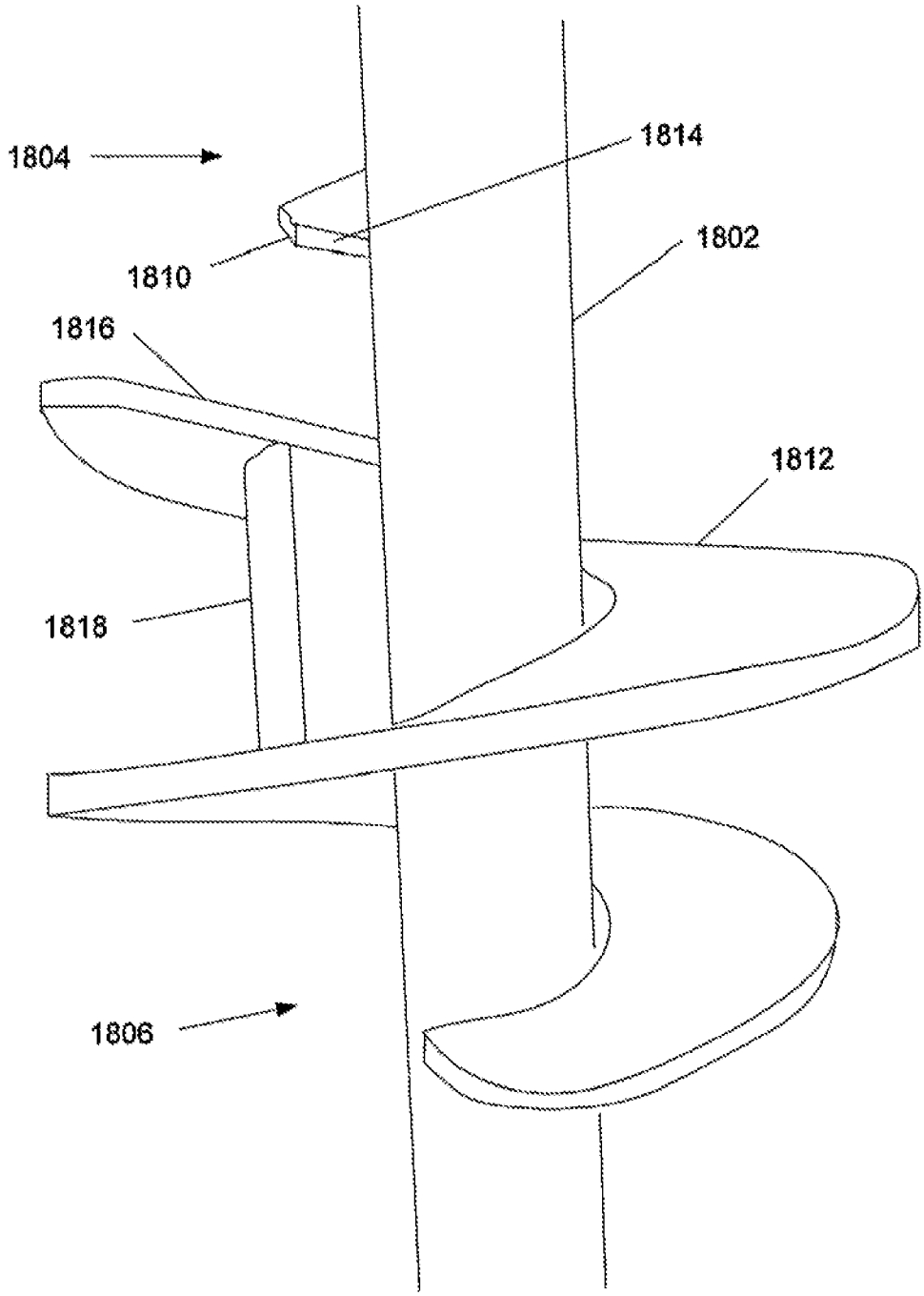
FIG. 22 depicts the bottom section of an auger shaft.

Referring now to FIG. 22, the bottom section 1806 of another auger grouted displacement pile is shown. The end of top section 1804 is shown which includes auger 1810, which is similar to auger 110. Both auger 1810 and helical blade 1812 coil about shaft 1802. Shaft 1802 may be hollow or solid. In those embodiments where auger 1810 is present, the diameter of auger 1810 is smaller than the diameter of blades 1812. During installation, auger 1810 acts to push grout downward toward blades 1812. After the grout has set, the lateral surfaces of auger 1810 help transfer the load from the pile shaft into the grout column and the surrounding soils. Attached to the side of shaft 1802 is a lateral compaction projection 1818. In the embodiment illustrated in FIG. 22, projection 1818 is a gusset that spans between adjacent coils of blade 1812 and also contacts trailing edge 1816 of blade 1812. In one such embodiment, the gusset is welded to both of the adjacent coils of blade 1812. In another embodiment, the lateral compaction projection is monolithic with respect to the shaft. In use, lateral compaction projection 1818 establishes a regular circumference which is subsequently filled with grout. For example, grout may be added around the shaft from its top during the installation of the shaft into the supporting medium. In one embodiment, lateral compaction projection 1818 is monolithic with regard to the shaft 1802. In another embodiment, lateral compaction projection 1818 is welded to shaft 1802.

Figure 23:
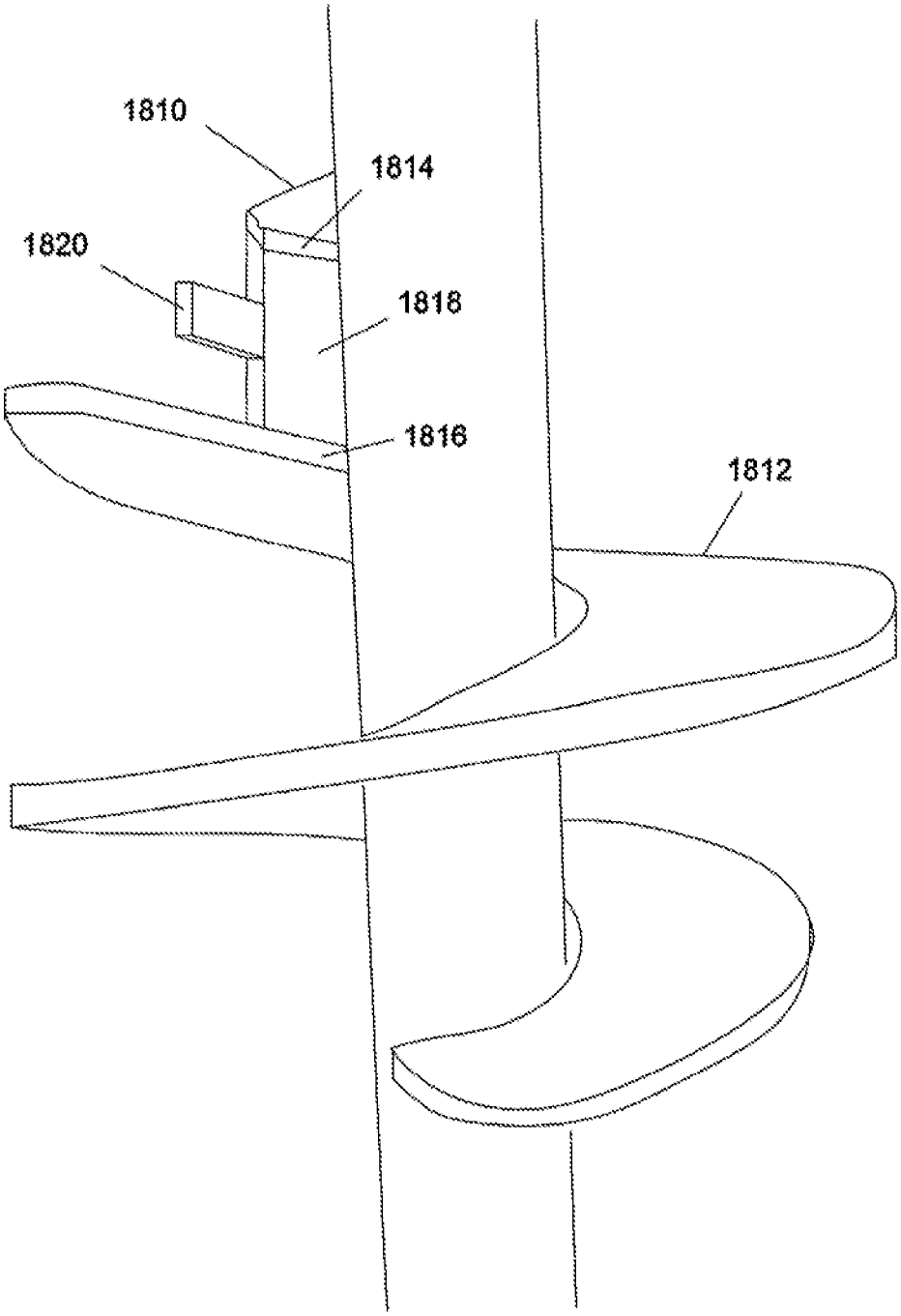
FIG. 23 illustrates the bottom section of another auger shaft.

FIG. 23 depicts another auger grouted displacement pile. The pile of FIG. 23 also includes a lateral compaction projection 1818 but the projection is disposed above the topmost flighting of the helical blade 1812 and below the bottommost flighting of the helical auger 1810. In the depicted embodiment, lateral compaction projection 1818 directly contacts the leading edge 1814 of auger 1810 and the trailing edge 1816 of blade 1812. In one such embodiment, the compaction projection 1818 is welded to one or both of auger 1810 and helical blade 1812 at the point of direct contact. In another embodiment, the projection 1818 is between the bottommost and topmost flightings but is separated therefrom. The embodiment of FIG. 23 also differs from that of FIG. 22 in that it includes deformation structure 1820. Like deformation structure 120, deformation structure 1820 forms irregularities in the circumference after compaction by the lateral compaction protrusion 1818. In FIG. 23, deformation structure 1820 extends laterally from lateral compaction protrusion 1818.

Figure 24A:
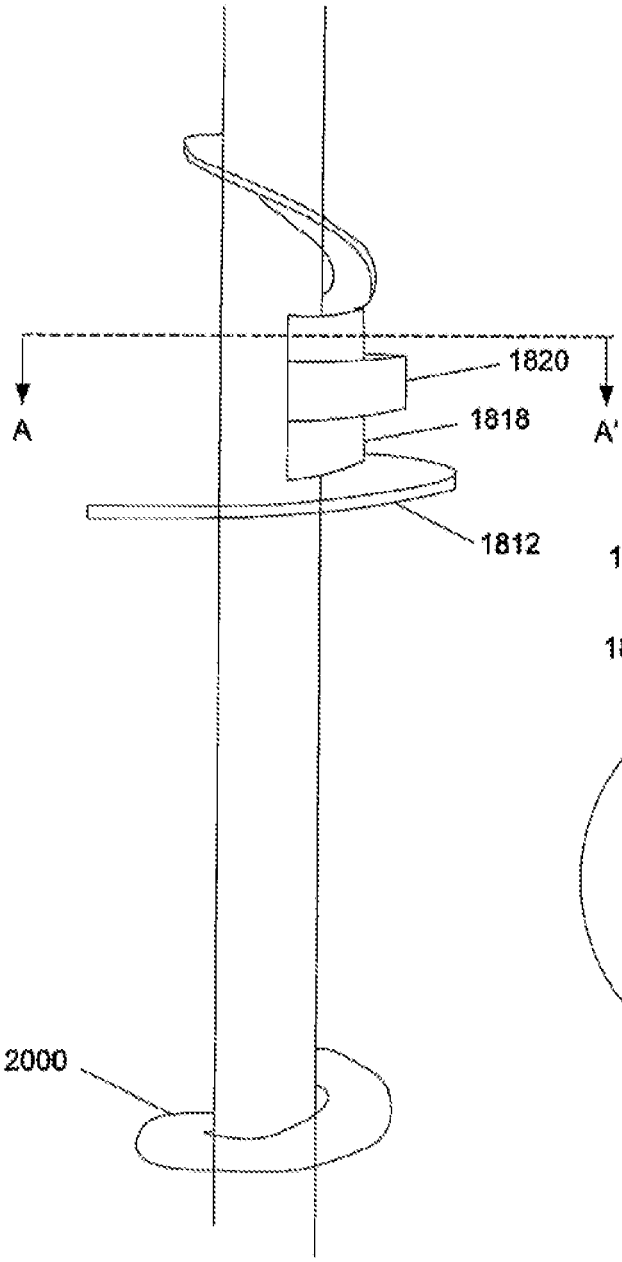
FIGS. 24A and 24B show yet another auger shaft column from a side and top view along line A-A', respectively.
Figure 24B:
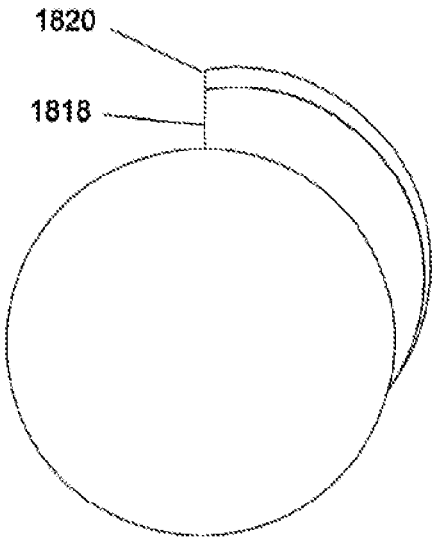

FIGS. 24A and 24B are similar to FIG. 23 except in that the lateral compaction projection 1818 and the deformation structure 1820 are elongated and wrap about a portion of the pile. In one aspect, a range between 45 and 360 degrees is covered by deformation structure 1820, including any subrange between. FIG. 24A provides a profile view while FIG. 24B shows a top view along line A-A'. In the embodiment depicted in FIG. 24B, the compaction projection 1818 and deformation structure 1820 wraps about the pile to cover about 90 degrees. In another embodiment, at least about 45 degrees are covered. In another embodiment, at least about 180 degrees are covered. In yet another embodiment, the entire surface (360 degrees) is covered, in yet another embodiment, more than 360 degrees is covered (e.g. multiple turns of a helix). The embodiment of FIGS. 24A and 24B show the width of compaction projection 1818 and deformation structure 1820 as diminishing over their length as the structure progresses around the circumference of the shaft. In another embodiment, the widths are consistent over their length. In yet another embodiment, the width increases as the structure progresses around the circumference of the shaft.

The embodiment of FIG. 24A includes a leading helix 2000 which is spaced apart from helical blade 1812 and lateral displacement projection 1818. Leading helix 2000 may be on the same shaft (e.g. monolithic or welded to the same shaft) as helical blade 1812 or may be on a separate shaft that is attached to the bottom section of the pile. In those situations where high density soil is disposed under a layer of loose, often corrosive soil, such a leading helix 2000 is particular advantageous. The leading helix 2000 penetrates the dense soil while the helical blade 1812 and the lateral displacement projection 1818 remain in the looser soil. The grout that fills the bore diameter protects the column from the corrosive soil while the leading helix 2000 is securely imbedded in the denser soil.

Figure 25:
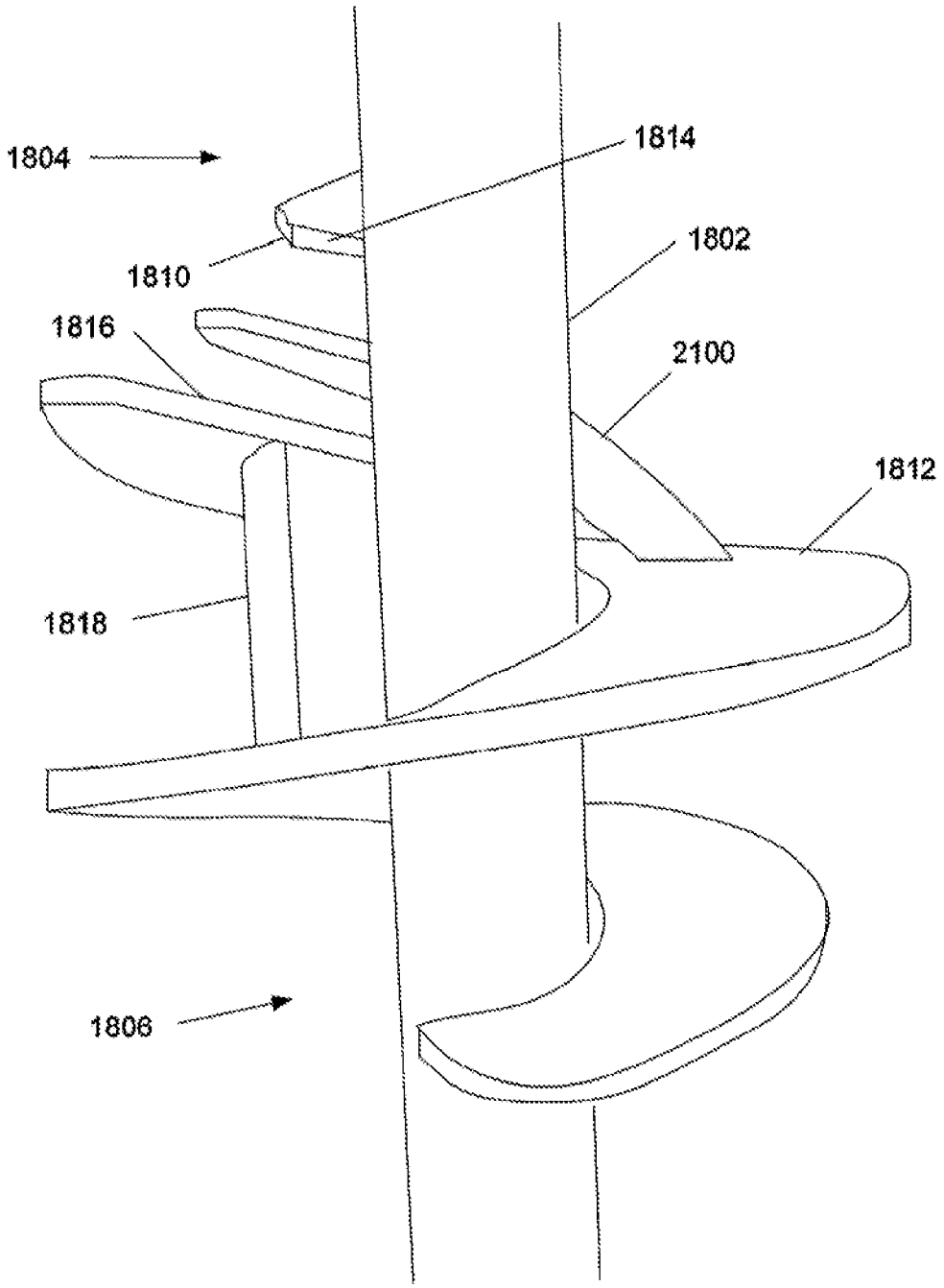
FIG. 25 depicts the bottom section of another auger shaft.

FIG. 25 depicts the bottom section 1806 of another auger shaft which is similar to the shaft of FIG. 22 except in that deformation structure 2100 is attached to the topmost flighting of helical blade 1812. In the embodiment of FIG. 25, the deformation structure 2100 is a helix whose pitch has the same handedness as helical blade 1812 but those pitch differs from the pitch of the blade 1812. The deformation structure 2100 is positioned above compaction projection 1818 such that irregularities are formed in the circumference.

PARTS LIST FOR FIGS. 1-26(*c*)

100 auger grouted displacement pile
102 elongated tubular pipe
104 top section
106 bottom section
108 soil displacement head
110 auger
112 blade
114 leading edge
116 trailing edge
120 deformation structure
200 lateral compaction element
202 width
204 height
206 end
208 end
300 hollow central chamber
302 means for extruding grout
304*a*-304*e* elongated openings
306 walls
308 walls
310 distal wall
312 channels
314 width, trailing edge
316 width
318 thickness
320 thickness, trailing edge
402 grooves
500 pile
502 auger section
504 pile
506 surface
600 mixing fins
700 coupling pile
702 coupling pile
704 coupling pile
800 pile assembly
802*a* pile section
802*b* pile section
804*a* flange
804*b* flange
806 fasteners
808 material
900 interface surface
1000 clearance holes
1100 cage
1102 internal grout
1200 rock socket
1202 bedrock
1204 concrete
1400 alignment sleeve
1500 pile assembly
1502*a* pile section
1502*b* pile section
1504*a* flange, filleted
1504*b* flange, filleted
1505*a* fillet
1505*b* fillet
1600 pile assembly
1602*a* pile section
1602*b* pile section
1604*a* teeth
1604*b* teeth
1606*a* flange
1606*b* flange
1802 shaft
1804 top section
1806 bottom section
1810 auger, helical
1814 leading edge
1816 trailing, edge
1818 projection
1820 deformation structure
2000 leading helix
2100 deformation structure
2200 pile assembly
2202 first pile section
2204 driving tip
2206 distal end
2208 proximal end
2210 first mated fitting
2212 second mated fitting
2213 projections, axial
2214 second pile section
2216 holes
2217 distal end, second pile section
2300 sleeve
2302 holes
2304 weld
2400 sleeve
2401 first sleeve portion
2402 holes
2406 second sleeve portion
2604 first pile or sleeve portion
2608 second pile or sleeve portion
2612 axial projections or teeth
2616 recesses
2704 first pile or sleeve portion
2708 second pile or sleeve portion
2712 axial projections or teeth
2715 lateral end feature
2716 recesses
2804 first pile or sleeve portion
2808 second pile sleeve portion
2812 axial projections or teeth (angled)
2816 recesses (angled)

While the invention has been described with reference to preferred embodiments, it will be understood by those stilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

It will be readily apparent that other variations and modifications are possible within the inventive ambits of the present invention, and in accordance with the following claims. For example, the pile sections of the first embodiment could be used in concert with the interlocking sleeve portions according to the embodiment according to FIG. 21.

What is claimed is:

1. A pile comprising:

a first pile section having a first end configured to engage a supporting medium, said first pile section having an opposing second end, said opposing second end having an integral mating end fitting having multiple projections and multiple recesses, each projection and recess of said integral mating end fitting of said opposing second end of said first pile section having a parallelogram shape to enable transfer of a torsion load, said first pile section having opposing first pile section through holes at said opposing second end;

a second pile section having a first end configured to engage said opposing second end of said first pile section, said second pile section having an opposing second end, said first end of said second pile section having an integral mating end fittings having multiple projections and multiple recesses, each projection and recess of said integral mating end fitting of said first end of said second pile section having a parallelogram shape to enable transfer of a torsion load, said multiple projections of said mating end fitting of said opposing second end of said first pile section engaging said multiple recesses of said first end of said second pile section and said multiple recesses of said mating end fitting of said opposing second end of said first pile section engaging said multiple projections of said first end of said second pile section to create an interlocking fit;

a first sleeve sized to overlay said opposing second end of said first pile section, said first sleeve having projections, said projections overlaying said opposing second end of said first pile section;

a second sleeve sized to overlay said first end of said second pile section and sized to overlay said opposing second end of said first pile section; and a fastener;

said second sleeve having projections, said projections of said second sleeve overlaying said opposing second end of said first pile section;

said first sleeve having recesses to engage said projections of said second sleeve;

said second sleeve having recesses to engage said projections of said first sleeve;

said first sleeve and said second sleeve creating an interlocking fit to enable transfer of a torsion load;

said second sleeve having opposing second sleeve through holes;

said first sleeve having no opposing through holes therein;

said opposing second sleeve through holes being alignable with said opposing first pile section through holes;

said fastener passing through said opposing second sleeve through holes and said opposing first pile section through holes to secure said second sleeve to said opposing second end of said first pile section.

2. The pile as recited in claim 1, wherein said first end of said first pile section includes a driving tip.

3. The pile as recited in claim 1, wherein said first end of said first pile section includes helical flighting.

4. The pile as recited in claim 1, further comprising:

a third pile section having a first end and an opposing second end;

said opposing second end of said second pile section having an integral mating end fitting having projections and recesses, said projections and recesses of said integral mating end fitting of said opposing second end of said second pile section being shaped to enable transfer of a torsion load;

said first end of said third pile section having an integral mating end fitting having projections and recesses, said projections and recesses of said integral mating end fitting of said first end of said third pile section being shaped to enable transfer of a torsion load;

said projections of said mating end fitting of said opposing second end of said second pile section engaging said recesses of said first end of said third pile section;

said recesses of said opposing second end of said second pile section engaging said projections of said mating end fitting of said first end of said third pile section to create an interlocking fit.

5. The pile as recited in claim 4, further comprising:

a third sleeve sized to overlay said opposing second end of said second pile section, said third sleeve having projections, said projections overlaying said opposing second end of said second pile section;

a fourth sleeve sized to overlay said first end of said third pile section and sized to overlay said opposing second end of said second pile section; and a second fastener;

said fourth sleeve having projections, said projections of said fourth sleeve overlaying said opposing second end of said second pile section;

said third sleeve having recesses to engage said projections of said fourth sleeve;

said fourth sleeve having recesses to engage said projections of said third sleeve;

said third sleeve and said fourth sleeve creating an interlocking fit to enable transfer of a torsion load;

said second end of said second pile section having opposing through holes;

said fourth sleeve having opposing fourth sleeve through holes;

said opposing fourth sleeve through holes of said fourth sleeve being alignable with said opposing through holes of said second pile section;

said second fastener passing through said opposing fourth sleeve through holes of said fourth sleeve and said opposing through holes of said second pile section to secure said fourth sleeve to said opposing second end of said second pile section.

6. The pile as recited in claim 1, wherein said projections and recesses are angled relative to a primary axis of a corresponding pile section.

7. A pile comprising:

a first pile section having a first end configured to engage a supporting medium, said first pile section having an opposing second end, said opposing second end of said first pile section having opposing first pile section through holes;

a second pile section having a first end and a second opposing end;

a first sleeve sized to overlay said opposing second end of said first pile section, said first sleeve having projections, said projections overlaying said opposing second end of said first pile section;

a second sleeve sized to overlay said first end of said second pile section and sized to overlay said opposing second end of said first pile section; and a fastener;

said second sleeve having projections, said projections of said second sleeve overlaying said opposing second end of said first pile section;

said first sleeve having recesses to engage said projections of said second sleeve;

said second sleeve having recesses to engage said projections of said first sleeve;

said first sleeve and said second sleeve creating an interlocking fit to enable transfer of a torsion load;

said second sleeve having opposing through holes;

said opposing through holes of said second sleeve being alignable with said opposing first pile section through holes;

said fastener passing through said opposing through holes of said second sleeve and said opposing first pile section through holes to secure said second sleeve to said opposing second end of said first pile section.

8. The pile as recited in claim 7, wherein said projections and recesses of said first sleeve are defined by irregular cuts and said projections and recesses of said second sleeve are defined by irregular cuts such that said irregular cuts of said first sleeve match said irregular cuts of said second sleeve to enable transfer of the torsion load.

9. The pile as recited in claim 7, wherein said first sleeve is secured to said first pile section and said second sleeve is secured to said second pile section.

10. The pile as recited in claim 7, wherein said first end of said first pile section includes a driving tip.

11. The pile as recited in claim 7, wherein said first end of said first pile section includes helical flighting.

12. The pile as recited in claim 7, wherein said projections and recesses are angled relative to a primary axis of a corresponding pile section when attached thereto.

13. The pile as recited in claim 7, wherein said projections have a shape in the form of a parallelogram with the exception of a distal end having a laterally extending feature;

said recesses being shaped to receive said projections having the shape in the form of a parallelogram including the laterally extending feature.

14. The pile as recited in claim 7, further comprising:

a third pile section having a first end and an opposing second end;

a third sleeve sized to overlay said first end of said third pile section, said third sleeve having projections, said projections of said third sleeve overlaying said first end of said third pile section;

a fourth sleeve sized to overlay said opposing second end of said second pile section and to overlay said first end of said third pile section, said fourth sleeve having projections, said projections of said fourth sleeve overlaying said opposing second end of said second pile section; and a second fastener;

said opposing second end of said second pile section having opposing second pile section through holes;

said third sleeve having recesses to engage said projections of said fourth sleeve;

said fourth sleeve having recesses to engage said projections of said third sleeve;

said third sleeve and said fourth sleeve creating an interlocking fit to enable transfer of a torsion load;

said fourth sleeve having opposing through holes;

said opposing through holes of said fourth sleeve being alignable with said opposing second pile section through holes;

said second fastener passing through said opposing through holes of said fourth sleeve and said opposing second pile section through holes to secure said fourth sleeve to said opposing second end of said second pile section.

15. The pile as recited in claim 14, wherein said opposing second end of said second pile section having an integral mating end fitting having projections and recesses, said projections and recesses of said integral mating end fitting of said opposing second end of said second pile section being shaped to enable transfer of a torsion load;

said first end of said third pile section being configured to engage said opposing second end of said second pile section, said first end of said third pile sections having an integral mating end fitting having projections and recesses, said projections and recesses of said integral mating end fitting of said first end of said third pile section being shaped to enable transfer of a torsion load;

said projections of said mating end fitting of said opposing second end of said second pile section engaging said recesses of said first end of said third pile section and said recesses of said mating end fitting of said opposing second end of said second pile section engaging said projections of said first end of said third pile section to create an interlocking fit.

16. The pile as recited in claim 7, wherein said opposing second end of said first pile section having an integral mating end fitting having projections and recesses, said projections and recesses of said integral mating end fitting of said opposing second end of said first pile section being shaped to enable transfer of a torsion load;

said first end of said second pile section being configured to engage said opposing second end of said first pile section, said first end of said second pile sections having an integral mating end fitting having projections and recesses, said projections and recesses of said integral mating end fitting of said first end of said second pile section being shaped to enable transfer of a torsion load;

said projections of said mating end fitting of said opposing second end of said first pile section engaging said recesses of said first end of said second pile section and said recesses of said mating end fitting of said opposing second end of said first pile section engaging said projections of said first end of said second pile section to create an interlocking fit.

17. A pile assembly comprising:

a first pile section having a first end configured to engage a supporting medium, said first pile section having an opposing second end, said opposing second end having an integral mating end fitting having multiple irregularly shaped projections and multiple irregularly shaped recesses, each irregularly shaped projection and irregularly shaped recess of said integral mating end fitting of said opposing second end of said first pile section being shaped to enable transfer of a torsion load, said first pile section having opposing first pile section through holes at said opposing second end;

a second pile section having a first end configured to engage said opposing second end of said first pile section, said second pile section having an opposing second end, said first end of said second pile section having an integral mating end fittings having multiple irregularly shaped projections and multiple irregularly shaped recesses, each irregularly shaped projection and irregularly shaped recess of said integral mating end fitting of said first end of said second pile section being shaped to enable transfer of a torsion load, said multiple irregularly shaped projections of said mating end fitting of said opposing second end of said first pile section engaging said multiple irregularly shaped recesses of said first end of said second pile section and said multiple irregularly shaped recesses of said mating end fitting of said opposing second end of said first pile section engaging said multiple irregularly shaped projections of said first end of said second pile section to create an interlocking fit;

a first sleeve sized to overlay said opposing second end of said first pile section, said first sleeve having projections, said projections overlaying said opposing second end of said first pile section;

a second sleeve sized to overlay said first end of said second pile section and sized to overlay said opposing second end of said first pile section; and a fastener;

said second sleeve having projections, said projections of said second sleeve overlaying said opposing second end of said first pile section;

said first sleeve having recesses to engage said projections of said second sleeve;

said second sleeve having recesses to engage said projections of said first sleeve;

said first sleeve and said second sleeve creating an interlocking fit to enable transfer of a torsion load;

said second sleeve having opposing second sleeve through holes;

said first sleeve having no opposing through holes therein;

said opposing second sleeve through holes being alignable with said opposing first pile section through holes;

said fastener passing through said opposing second sleeve through holes and said opposing first pile section through holes to secure said second sleeve to said opposing second end of said first pile section.

* * * * *